US008915544B2

(12) United States Patent
LaPointe

(10) Patent No.: US 8,915,544 B2
(45) Date of Patent: Dec. 23, 2014

(54) FURNITURE MEMBER WITH MECHANISM FOR POWERED OCCUPANT LIFT

(75) Inventor: Larry P. LaPointe, Temperance, MI (US)

(73) Assignee: La-Z-Boy Incorporated, Monroe, MI (US)

( * ) Notice: Subject to any disclaimer, the term of this patent is extended or adjusted under 35 U.S.C. 154(b) by 433 days.

(21) Appl. No.: 13/218,740

(22) Filed: Aug. 26, 2011

(65) Prior Publication Data

US 2013/0049411 A1 Feb. 28, 2013

(51) Int. Cl.
*A47C 1/031* (2006.01)
*A61G 5/14* (2006.01)

(52) U.S. Cl.
CPC . *A61G 5/14* (2013.01); *Y10S 297/10* (2013.01)
USPC ..... 297/85 M; 297/85 R; 297/DIG. 10

(58) Field of Classification Search
USPC ..... 297/85 R, 85 M, DIG. 10
See application file for complete search history.

(56) References Cited

U.S. PATENT DOCUMENTS

| | | | |
|---|---|---|---|
| 4,690,457 | A | 9/1987 | Poncy et al. |
| 4,752,101 | A | 6/1988 | Yurchenco et al. |
| 4,852,939 | A | 8/1989 | Krauska |
| 5,222,286 | A | 6/1993 | Saul et al. |
| 5,265,935 | A | 11/1993 | Geisler |
| 5,288,126 | A | 2/1994 | Saul et al. |
| 5,520,439 | A | 5/1996 | Blount |
| 5,524,303 | A | 6/1996 | Palmer, Jr. et al. |
| 5,651,580 | A | 7/1997 | LaPointe et al. |
| 5,730,494 | A | 3/1998 | LaPointe et al. |
| 5,747,965 | A | 5/1998 | LaPointe et al. |
| 5,806,920 | A | 9/1998 | Blount |
| 5,992,931 | A | 11/1999 | LaPointe |
| 6,338,531 | B1 | 1/2002 | Hausherr |
| 6,491,342 | B1 | 12/2002 | Smith |

(Continued)

FOREIGN PATENT DOCUMENTS

| | | | |
|---|---|---|---|
| CA | 2118204 | * | 3/2005 |
| DE | 102009022567 | * | 1/2011 |
| EP | 1972315 | * | 9/2008 |
| FR | 2945719 | * | 11/2010 |

OTHER PUBLICATIONS

International Search Report for PCT/US2012/052069 mailed Feb. 19, 2013.

(Continued)

*Primary Examiner* — David E Allred
(74) *Attorney, Agent, or Firm* — Harness, Dickey & Pierce, P.L.C.

(57) ABSTRACT

A furniture member providing powered occupant lift includes a mechanism having a mechanism support base, a support base side movably connected to the mechanism support base, and a mechanism inner portion connected to the support base side. The mechanism inner portion includes a seat back portion; a leg rest portion; and a first drive assembly connected to the mechanism inner portion sequentially operating to extend the leg rest portion from a stowed to a fully extended position followed by seat back portion rotation from an upright to a fully reclined position. A second drive assembly connected between the mechanism support base and the support base side displaces the support base side and the mechanism inner portion with respect to the mechanism support base. A frame structure connected to the support base side is moved to at least a forward fully raised position by operation of the lift/drive mechanism.

38 Claims, 23 Drawing Sheets

(56) References Cited

U.S. PATENT DOCUMENTS

| | | | | |
|---|---|---|---|---|
| 6,492,786 | B1 | 12/2002 | Vang et al. | |
| 6,659,556 | B2 | 12/2003 | Pellerin | |
| 6,729,686 | B2 * | 5/2004 | May | 297/84 |
| 6,794,841 | B1 | 9/2004 | Vang et al. | |
| 6,823,545 | B1 | 11/2004 | Davis | |
| 7,000,988 | B2 | 2/2006 | Bressler et al. | |
| 7,090,297 | B2 | 8/2006 | Mohn et al. | |
| 7,311,359 | B2 | 12/2007 | Smith | |
| 7,455,360 | B2 | 11/2008 | White et al. | |
| 7,600,817 | B2 | 10/2009 | Kramer et al. | |
| 7,722,114 | B2 | 5/2010 | Smith | |
| 7,766,421 | B2 | 8/2010 | Lawson | |
| 7,850,238 | B2 | 12/2010 | Erb et al. | |
| 8,506,009 | B2 * | 8/2013 | LaPointe et al. | 297/85 M |
| 2011/0193373 | A1 * | 8/2011 | Lawson et al. | 297/71 |

OTHER PUBLICATIONS

Written Opinion of the International Searching Authority for PCT/US2012/052069 mailed Feb. 19, 2013.

* cited by examiner

FURNITURE MEMBER WITH MECHANISM FOR POWERED OCCUPANT LIFT

FIELD

The present disclosure relates to an electrically powered furniture member having a mechanism used for providing leg rest extension and retraction, seat back rotation, and occupant lift.

BACKGROUND

This section provides background information related to the present disclosure which is not necessarily prior art.

Furniture members including chairs have included power operators to move the seating surface forward and angle it downward such that an occupant of the furniture member can move from a seated position to a standing position with reduced effort. Such furniture members are commonly known as powered lift chairs or lift-recliners.

Problems with known lift-recliner members include reduced comfort due to limited seating positions, awkward lift position angles that do not maximize the transition from a seated position to a standing position, and cost due to mechanism complexity including the use of 3 motor/operators with one each for seat back rotation, leg rest extension/retraction, and lift rotation.

SUMMARY

This section provides a general summary of the disclosure, and is not a comprehensive disclosure of its full scope or all of its features.

According to several embodiments of a mechanism and chair for powered occupant lift of the present disclosure, a furniture member providing powered occupant lift includes a mechanism. The mechanism includes a mechanism support base. A mechanism inner portion support frame is movably connected to the mechanism support base. A mechanism inner portion is fixed to the mechanism inner portion support frame and is therefore movable with respect to the mechanism support base. A first drive assembly is connected to the mechanism inner portion. A second drive assembly is connected between the mechanism support base and the mechanism inner portion support frame operating to displace both the mechanism inner portion support frame and the mechanism inner portion with respect to the mechanism support base. A frame structure connected to the support base side is moved to at least a forward fully raised position by operation of the lift/drive mechanism.

According to other embodiments, a furniture member providing powered occupant lift includes a mechanism having a mechanism support base having a support base side movably connected to the mechanism support base and a mechanism inner portion connected to the support base side. The mechanism inner portion includes a seat back portion; a leg rest portion; and a first drive assembly connected to the mechanism inner portion sequentially operating to extend the leg rest portion from a stowed to a fully extended position followed by rotation of the seat back portion from an upright to a fully reclined position. A second drive assembly connected between the mechanism support base and the support base side operates to displace the support base side and the mechanism inner portion with respect to the mechanism support base. A frame structure is connected to the support base side and moved to at least a forward fully raised position by operation of the lift/drive mechanism.

According to further embodiments, a furniture member providing powered occupant lift includes a mechanism having a mechanism support base having support base first and second sides movably connected to the mechanism support base. A mechanism inner portion support frame is connected to the first and second sides. A mechanism inner portion is connected to and supported on the mechanism inner portion support frame. The mechanism inner portion includes first and second seat back support elements; first and second pantograph linkage sets; and a seat back/leg rest drive assembly connected to the mechanism inner portion operating to sequentially extend/retract the first and second pantograph linkage sets and then rotate the first and second seat back support elements. A lift/drive assembly is connected to the mechanism support base and by a connecting shaft to the support base first and second sides operating to rotate the connecting shaft to displace the support base first and second sides with respect to the mechanism support base. A base member is fixedly and non-movably connected to the mechanism support base. A frame structure connected to both the support base first and second sides is rotated with respect to the base member by operation of the lift/drive assembly to rotate the mechanism inner portion support frame to at least a fully raised position to assist an occupant supported by the mechanism inner portion to move to a standing position.

According to other embodiments, a furniture member providing powered occupant lift includes a base member having a front base side connecting piece. A mechanism having a mechanism support base is connected to the base member. A mechanism inner portion support frame is rotatable with respect to the base member and a leg rest member. At least one drive assembly connected to the mechanism operates to rotate the mechanism inner portion support frame with respect to the base member. A frame structure is connected to the mechanism and rotated to at least a forward fully raised position by operation of the at least one drive assembly. The leg rest member at the forward fully raised position is oriented at an angle with respect to the front base side connecting piece. The frame structure has a front lower corner displaced forward of the front base side connecting piece at the forward fully raised position thereby creating a cavity between the front lower corner, the front base side connecting piece, and a planar surface supporting the base member.

According to further embodiments, a furniture member providing powered occupant lift includes a base member having first and second base sides. A mechanism includes a mechanism support base fixedly connected to the first and second base sides, a mechanism inner portion support frame rotatable with respect to the base member, and a leg rest member extensible from the mechanism by first and second pantograph linkage sets. A first drive assembly connected to the mechanism operating in a first mode extends the first and second pantograph linkage sets and thereby extends the leg rest member to a fully extended position. A second drive assembly connected between the mechanism support base and the mechanism inner portion support frame operates to displace the mechanism inner portion support frame with respect to the mechanism support base. A frame structure is connected to the mechanism and is rotated to each of a rearward zero gravity position or a forward fully raised position by operation of the second drive assembly. The leg rest member is positioned at the fully extended position and is elevated substantially level with a waist elevation of an occupant of the furniture member defining the rearward zero gravity position.

According to still other embodiments, a mechanism and chair for powered occupant lift includes a mechanism having a mechanism support base having support base first and second sides. A mechanism outer portion first side and a mechanism outer portion second side are each connected to one of the support base first or second sides, both movable with respect to the support base. A mechanism inner portion is movably connected to the mechanism outer portion first and second sides. The mechanism inner portion includes first and second seat back support elements each rotatably connected to one of the mechanism outer portion first and second sides; first and second pantograph linkage sets each rotatably connected for both extension and retraction to one of the mechanism outer portion first and second sides; and a seat back/leg rest drive assembly connected to the mechanism inner portion operating to sequentially extend/retract the first and second pantograph linkage sets and rotate the first and second seat back support elements. A lift/drive assembly connected to the mechanism support base and to both the mechanism outer portion first and second sides displaces the mechanism outer portion first and second sides with respect to the mechanism support base. A base member is fixedly and non-movably connected to the support base first and second sides. A frame structure connected to both the mechanism outer portion first and second sides is rotated by operation of the lift/drive assembly to at least a fully raised position to assist an occupant seated on the chair to move to a standing position.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Figure 1:
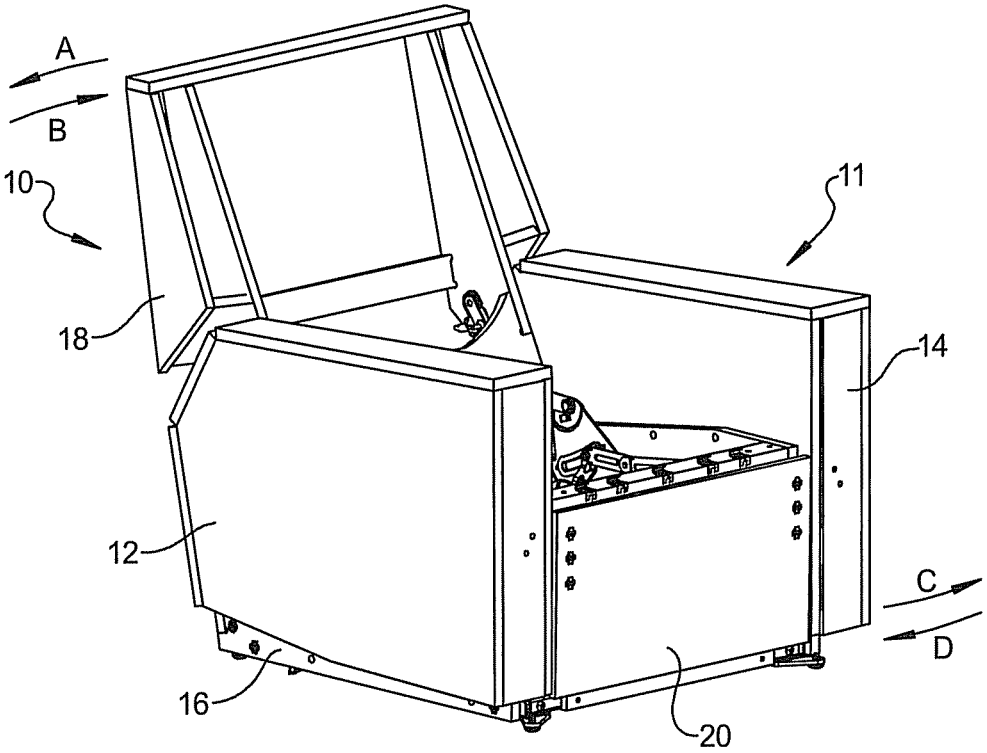
FIG. 1 is a front right perspective view of a furniture member defining a chair having a mechanism for powered occupant lift with the chair in a seat back upright and leg rest stowed position.

Referring to FIG. 1, a furniture member 10 includes a frame structure 11 having a first arm member 12 for supporting a right arm of an occupant and a second arm member for supporting a left arm of an occupant of the furniture member 10. Frame structure 11 is supported from and movable with respect to a base member 16 which is non-movably supported on a planar surface such as a floor during operation of furniture member 10. A seat back member 18 is rotatably connected to furniture member 10 and is movable from an upright position shown in a reclining direction "A" to a fully reclined position shown and described in reference to FIG. 10, and returned in an upright rotation direction "B" to the upright position.

Frame structure 11 can further include a leg rest member 20 which can be rotated from the leg rest retracted or stowed position shown in a leg rest extension direction "C". After extension, which will be shown and described in greater detail in reference to FIGS. 7-10, leg rest member 20 can be returned in a leg rest retraction direction "D" to the stowed position. Frame structure 11, seat back member 18, and base member 16 can be covered with upholstery (not shown for clarity) to provide for comfort of the occupant and in one or more colors and shapes for a desired appearance of furniture member 10.

Figure 2:
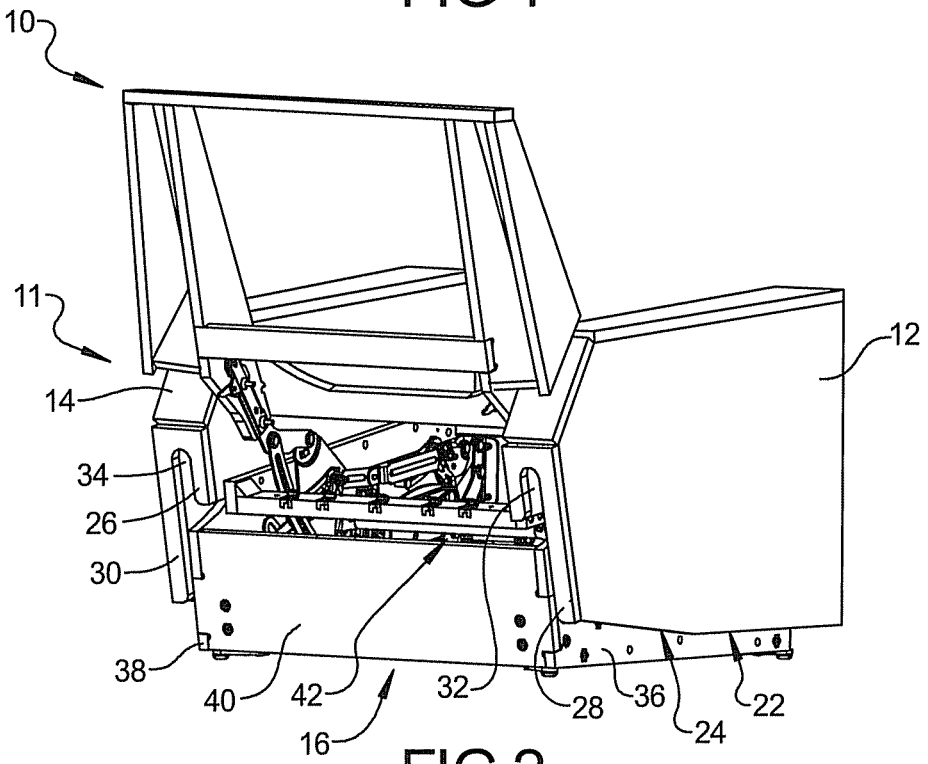
FIG. 2 is a rear right perspective view of the furniture member of FIG. 1.

Referring to FIG. 2, frame structure 11 of furniture member 10 can further include a first arm bottom face 22 which is angularly oriented with respect to a second arm bottom face 24 of first arm member 12. Second arm member 14 includes similar surfaces which are not clearly visible in this view. The purpose for the orientation of first and second arm bottom faces 22, 24 is to provide clearance to the ground or floor surface for the various forward and/or rearward rocking motions of frame structure 11 with respect to base member 16.

An arm member extending piece 26 is connected to each of the first and second arm members 12, 14. Arm member extending piece 26 includes a first extending piece wing 28 connected to first arm member 12 and a second extending piece wing 30 connected to second arm member 14. A first wing cavity 32 is created in first extending piece wing 28, and a similar second wing cavity 34 is created in second extending piece wing 30. First and second wing cavities 32, 34 provide clearance for rotation of frame structure 11 with respect to base member 16.

Base member 16 can include multiple components including opposed first and second base sides 36, 38 which are commonly joined using a rear base side connecting piece 40. The first and second base sides 36, 38 as well as the rear base side connecting piece 40 together partially surround and enclose a mechanism 42 which provides for the various individual motions of the components of furniture member 10.

Referring to FIG. 3 and again to each of FIGS. 1 and 2, the components of mechanism 42 include a mechanism support base 44 having a support base first side 46 connected to first base side 36 and a support base second side 48 connected to second base side 38. Base member 16 is, therefore, substantially fixed with respect to mechanism support base 44. A support base front connector 50 fixedly connects support base first and second sides 46, 48. A plurality of base side attachment fasteners 52 are included with both support base first and second sides 46, 48 for attachment of first and second base sides 36, 38.

A mechanism inner portion 54 is movably connected to mechanism support base 44. Mechanism inner portion 54 includes each of a first inner portion plate 56 and an opposite second inner portion plate 58. Extending from each of the first and second inner portion plates 56, 58 are a first seat back support element 60 and a second seat back support element 62, respectively. First and second seat back support elements 60, 62 are connected to seat back member 18, thereby allowing rotation of seat back member 18 in either of the reclining direction "A" or upright direction "B". The first and second inner portion plates 56, 58 and the first and second seat back support elements 60, 62 together define a seat back portion of mechanism inner portion 54. Mechanism inner portion 54 further includes each of a first pantograph linkage set 64 rotatably connected to first inner portion plate 56, and a second pantograph linkage set 66 rotatably connected to second inner portion plate 58. First and second pantograph linkage sets 64, 66 are fixedly connected to leg rest member 20 and thereby permit extension or retraction of leg rest member 20 in either of the leg rest extension direction "C" or leg rest retraction direction "D". The first and second pantograph linkage sets 64, 66 and the first and second shown and the first and second extension link sets 136, 138 shown and described in better detail in reference to FIG. 8 together define a leg rest portion of mechanism inner portion 54.

A first drive assembly 68 acting as an independent seat back/leg rest drive assembly is connected to mechanism inner portion 54 and rotates therewith. The functions of first drive assembly 68 include powered rotation of first and second seat back support elements 60, 62, as well as extension and retraction of the first and second pantograph linkage sets 64, 66. Mechanism support base 44 also includes a second drive assembly 70 acting as a lift drive assembly connected thereto. The purpose and function of second drive assembly 70 will be better described in reference to FIGS. 6 and 15.

First drive assembly 68 rotates and displaces a drive rod 72 having opposite ends received within curved elongated channels 74 created in each of a first and second sequencing plate 75, 76. The position of drive rod 72 in the curved elongated channels 74 determines the position of seat back member 18 as well as the leg rest member 20. All of the components of mechanism inner portion 54 are connected to and are thereby supported on a mechanism inner portion support frame 77. Mechanism inner portion support frame 77 is displaceable with respect to mechanism support base 44.

Figure 3:
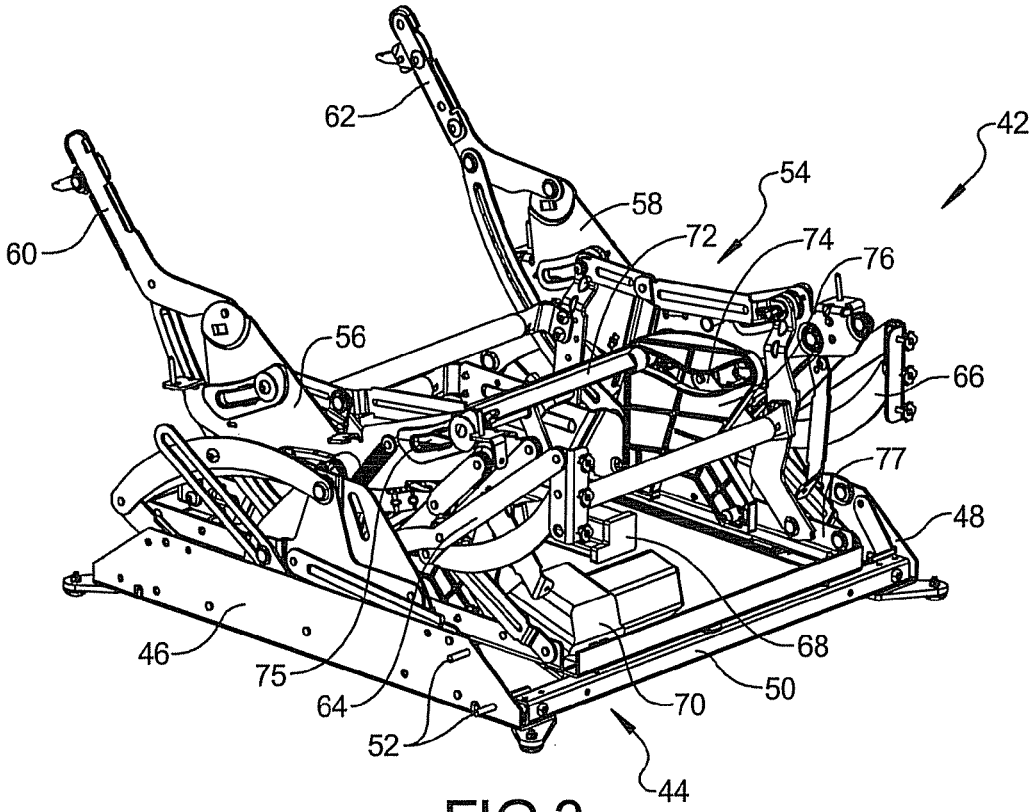
FIG. 3 is a front right perspective view of a mechanism for powered occupant lift of the present disclosure showing the mechanism in a seat back upright and leg rest retracted position.

Referring to FIG. 4 and again to FIG. 3, in addition to support base front connector 50, the mechanism support base 44 further includes a support base rear connector 78 which is fixedly connected to and thereby joins support base first and second sides 46, 48. Further components provided with mechanism support base 44 include oppositely positioned mechanism outer portion first and second sides 80, 82 each individually rotatably connected to one of the support base first or second sides 46, 48. The components of mechanism outer portion first side 80 are substantially equivalent to, but oriented in a mirror image configuration with respect to, mechanism outer portion second side 82. The following description of the components of mechanism outer portion first side 80 thereby applies equally to mechanism outer portion second side 82. A lift drive plate 84 fixedly connected to a support plate 85 are commonly rotatably connected to support base first side 46 using at least one link which can include an arc shaped guide link 86 which is rotatably connected to a guide connecting link 88 which itself is rotatably connected to support base first side 46. A guide link displacement member 90 is rotatably connected to lift drive plate 84 and to arc shaped guide link 86. Lift drive plate 84 is also rotatably connected to support base first side 46 using a first guide rotation link 92. Each of the links described herein are provided with rotatable support using a plurality of rotational fasteners 94, such as spin rivets.

Structural members are provided to fixedly connect first inner portion plate 56 to second inner portion plate 58. These include a lower rear cross support member 96 and an upper rear cross member 98, as well as a front cross support member 100. The first drive assembly 68 includes a drive motor 102 connected to a drive gear housing 104. The drive gear housing 104 contains a drive gear (not shown) such as a worm gear which provides a displacement force which is converted to an axial rotation force to axially rotate drive rod 72.

Figure 5:
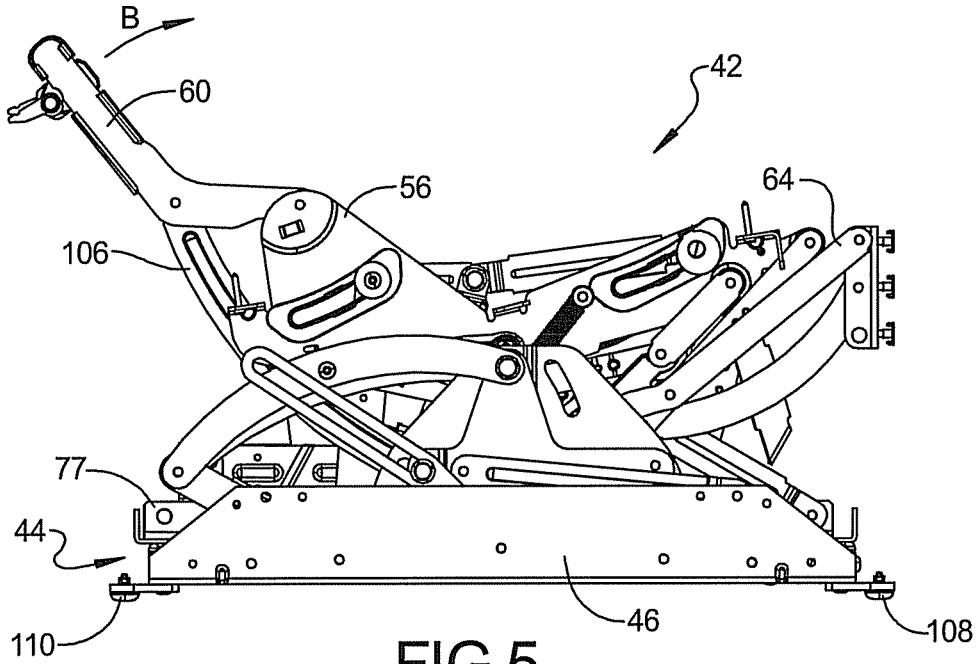
FIG. 5 is a right side elevational view of the mechanism of FIG. 3.

Referring to FIG. 5, the right side of mechanism 42 is shown; however, components of the left side (not shown) are mirror images and therefore are not discussed. Mechanism inner portion 54 further includes first and second seat back guide links 106, 106' (only first seat back guide link 106 is clearly visible in this view). First and second seat back guide links 106, 106" are individually rotatably connected to the mechanism inner portion support frame 77, and to the first and second seat back support elements 60, 62, to provide for rotational support during movement of the first and second seat back support elements 60, 62. Mechanism support base 44 further includes adjustable height front feet 108 and rear feet 110 connected to the front and rear of both support base first and second sides 46, 48.

Figure 4:
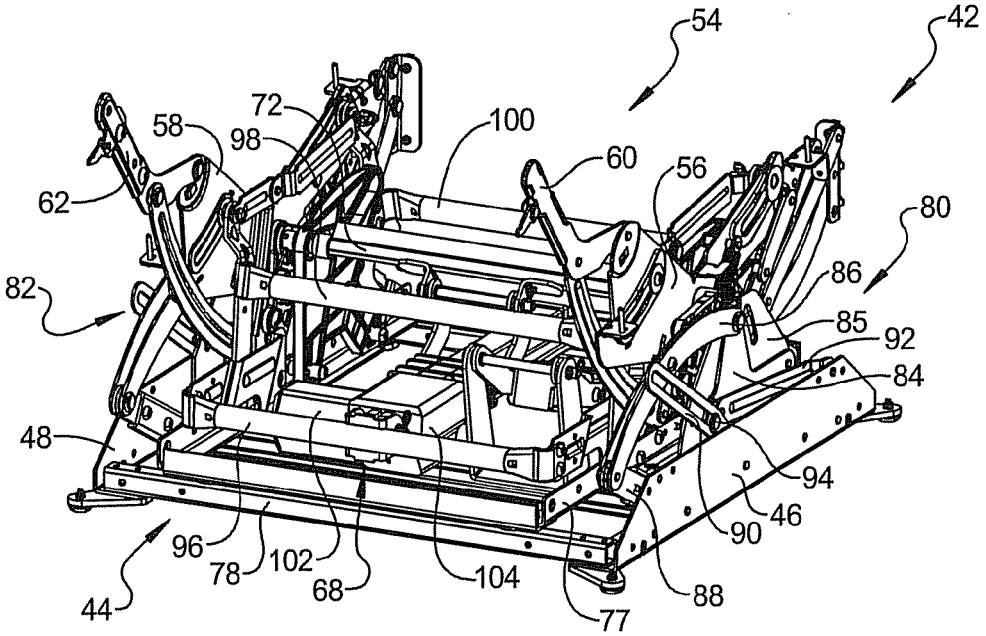
FIG. 4 is a rear right perspective view of the mechanism of FIG. 3.

Referring to FIG. 6 and again to FIGS. 3 and 4, mechanism support base 44 includes additional components which form part of or are operated directly by second drive assembly 70. Second drive assembly 70 includes a lift drive motor 112 which is connected to a lift drive assembly 114. A lift drive gear housing 116 is connected to lift drive assembly 114. Operation of lift drive motor 112 rotates a gear (not shown) such as a worm drive gear positioned within lift drive gear housing 116. Operation of the gear subsequently displaces a sliding gear housing coupling 118 which is slidably disposed with respect to lift drive gear housing 116. The axial sliding displacement of sliding gear housing coupling 118 with respect to lift drive gear housing 116 is translated to a rotational motion by connection of sliding gear housing coupling 118 using each of a first and second coupling arm 120, 122 to a coupling bracket 124. A connecting pin 126 rotatably connects the first and second coupling arms 120, 122 to coupling bracket 124. Coupling bracket 124 is, in turn, rotatably connected using a rotatable connector 128 through a connecting shaft 129. Connecting shaft 129 is, in turn, fixedly connected to each of the guide connecting links 88, 88' such that axial rotation of connecting shaft 129 also rotates both guide connecting links 88, 88'.

Figure 6:
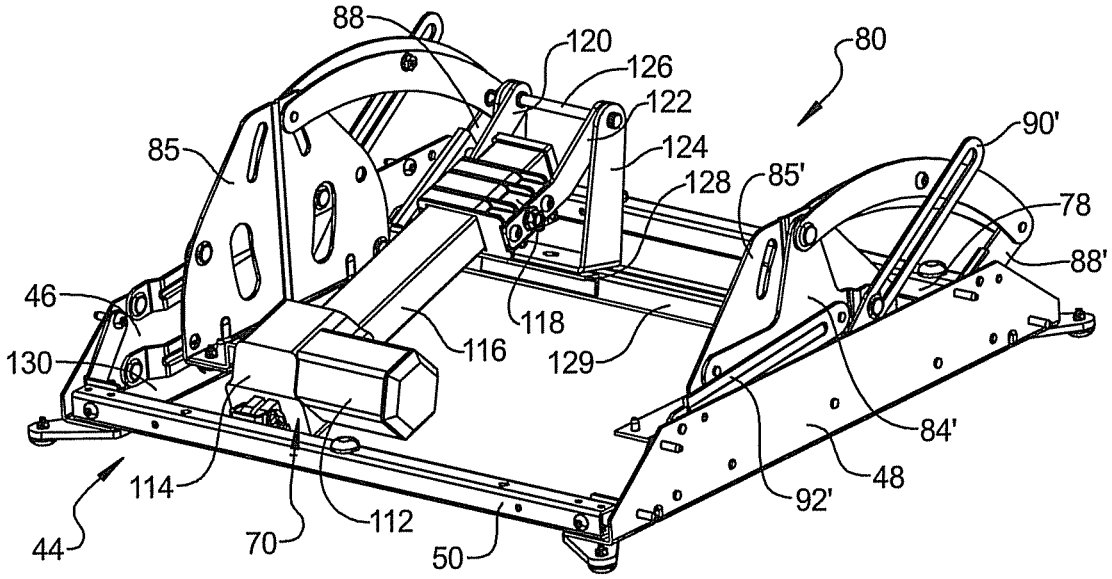
FIG. 6 is a front left perspective view modified from FIG. 3 to show only the occupant lift portion of the mechanism.

With continuing reference to FIG. 6, to further stiffen the assembly of mechanism support base 44, each of the support base first and second sides 46, 48 further includes a support base flange 130 directed inwardly and oriented substantially perpendicularly to the support base first and second sides 46, 48. The support base flange 130' of support base second side 48 is not clearly visible in this view. The orientation of components shown in FIG. 6 for mechanism support base 44 is oriented in a neutral or seat back upright and leg rest stowed position which corresponds to the furniture member 10 position shown and described in reference to FIGS. 1 and 2. This includes having the seat back member 18 in the fully upright position and the leg rest member 20 in the fully retracted or stowed position.

Referring to FIG. 7 and again to FIG. 2, furniture member 10 is shown following displacement of the frame structure 11 with respect to base member 16 in a combination forward/lowering direction "E". To reach the frame structure lowered position, leg rest member 20 is rotated away from the stowed position and toward the leg rest extension direction "C" to reach a fully extended position. The fully extended position is reached by extension of the first and second pantograph linkage sets 64, 66 (only first pantograph linkage set 64 is visible in this view). Further mechanism component displacement during this movement will be described in reference to FIGS. 8 and 9.

During the displacement of frame structure 11 in the forward/lowering direction "E", the first and second extending piece wings 28, 30, including the first and second wing cavities 32, 34 are displaced downwardly such that the first and second wing cavities 32, 34 receive the first and second base sides 36, 38 (which are fixed in height). The frame structure 11 also rotates rearwardly during the downward displacement in the lowering direction "E" such that second arm bottom face 24 is moved to an orientation approaching co-planar and parallel with respect to a base side bottom face 132 of each of the first and second base sides 36, 38. The angular difference between second arm bottom face 24 and first arm bottom face 22 is, therefore, provided to permit this rearward rotation of frame structure 11 with respect to base member 16 while preventing second arm bottom face 24 from reaching a position closer to the floor support surface than that provided by base side bottom face 132. Forward/lowering direction "E" further includes a component of forward movement such that arm member extending piece 26 moves to a position forward of rear base side connecting piece 40.

Figure 8:
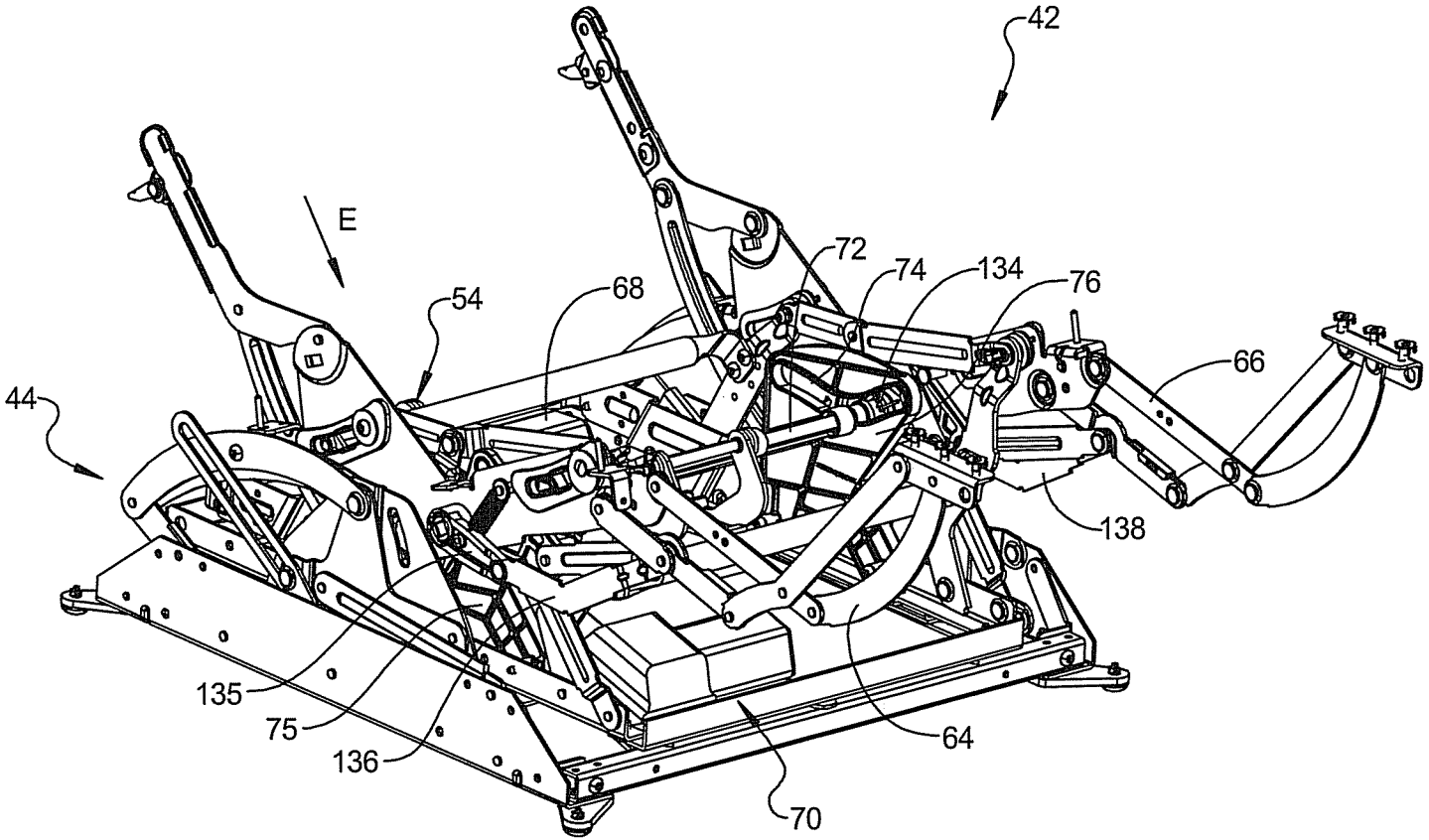
FIG. 8 is a front right perspective view of the mechanism following displacement to the leg rest extended mechanism lowered position.
Figure 9:
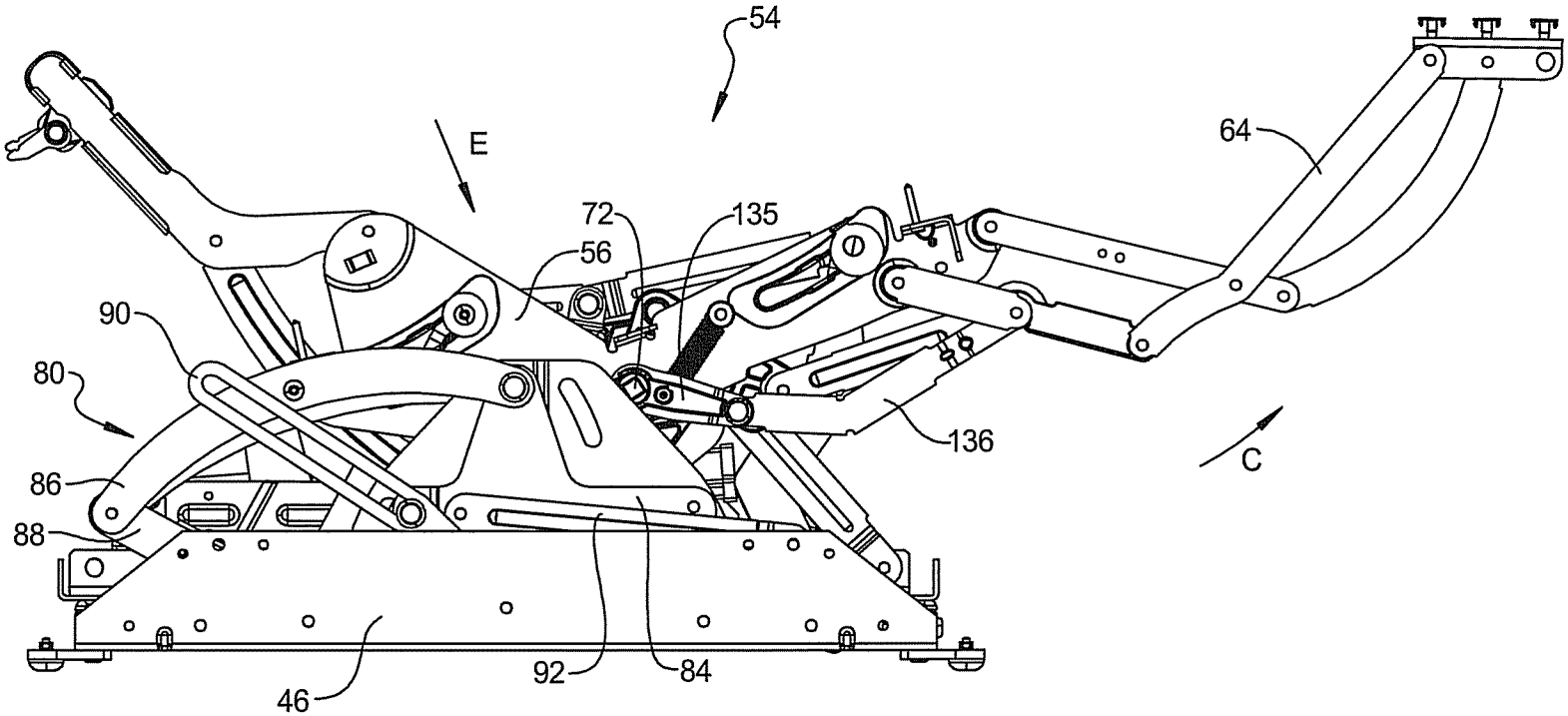
FIG. 9 is a right side elevational view of the mechanism of FIG. 8.

Referring to FIG. 8, the downward and forward displacement of mechanism inner portion 54 with respect to mechanism support base 44 in the forward/lowering direction "E" occurs in part by movement of the drive rod 72 in a generally downward and forward direction as it displaces to a lowest elevation slot position 134 of curved elongated channel 74. This displacement, as well as an axial rotation of drive rod 72, results in the extension of first and second pantograph linkage sets 64, 66. To extend and/or retract the first and second pantograph linkage sets 64, 66, the mechanism inner portion 54 further includes opposed first and second extension link sets 136, 138 which assist with extension/retraction of and provide support for first and second pantograph linkage sets 64, 66. Axial rotation of drive rod 72 during operation of first drive assembly 68 rotates drive links 135, 135' (only drive link 135 is clearly visible in this view) which are individually connected to each of the first and second extension link sets 136, 138, thereby extending or retracting the first and second extension link sets 136, 138. During the displacement of mechanism inner portion 54 in the forward/lowering direction "E" as the first and second pantograph linkage sets 64, 66 extend in the leg rest extension direction "C", only first drive assembly 68 is operated. Second drive assembly 70 is not energized during this operation.

Referring to FIG. 9 and again to FIG. 8 as noted above, second drive assembly 70 is not energized; therefore the components of mechanism outer portion first side 80 as well as the components of mechanism outer portion second side 82 (not visible in this view) are not effected. Arc shaped guide link 86, guide connecting link 88, guide link displacement member 90, and first guide rotation link 92, each connected to lift drive plate 84, are not displaced during the displacement of mechanism inner portion 54 in the forward/lowering direction "E" to reach the frame structure lowered and leg rest fully extended position.

Referring to FIG. 10 and again to FIG. 7, after leg rest member 20 has reached the fully extended position by rotation in the leg rest extension direction "C", if seat back member 18 is subsequently rotated in the reclining direction "A" to the fully retracted position shown, frame structure 11 further moves in an upward/forward displacement direction "F" with respect to base member 16. This forward motion provides furniture member 10 with a minimum wall proximity position. During the displacement in upward/forward displacement direction "F", second arm bottom face 24 of first arm member 12 rises upwardly and therefore increases in distance away from base side bottom face 132. Also, first extending piece wing 28 moves forwardly, creating additional spacing between first extending piece wing 28 and rear base side connecting piece 40. The movements of the components of mechanism 42 during this operation will be described in reference to FIG. 11.

Figure 10:
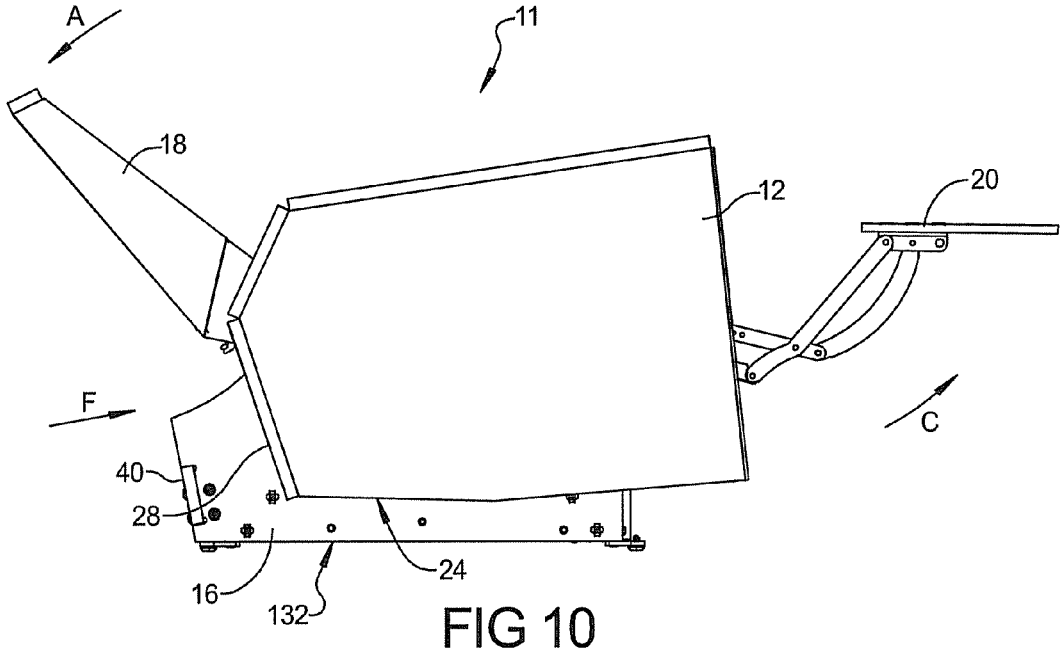
FIG. 10 is a right side elevational view of the furniture member following displacement to the leg rest extended, seat back fully reclined, and mechanism lowered position.
Figure 11:
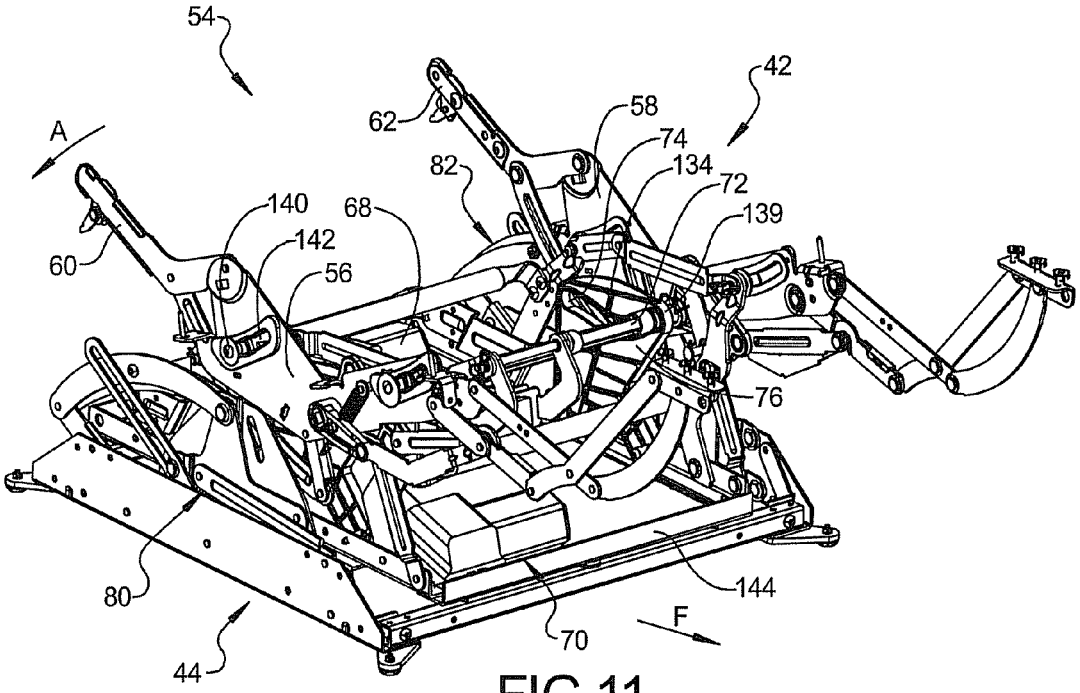
FIG. 11 is a front right perspective view of the mechanism following displacement to the leg rest extended, seat back fully reclined, and mechanism lowered position of FIG. 10.

Referring to FIG. 11 and again to FIG. 10, mechanism 42 is shown following the completion of seat back rotation to reach the seat back reclined and leg rest fully extended position shown in FIG. 10. To rotate first and second seat back support elements 60, 62 in the reclining direction "A", first drive assembly 68 is further operated, which displaces drive rod 72 upward and forward toward a second channel end wall 139 of curved elongated channel 74. This combined upward and forward displacement of drive rod 72 raises mechanism inner portion 54 with respect to mechanism support base 44. During the rotation of first and second seat back support elements 60, 62 in the reclining direction "A", seat back motion pins 140 are also rearwardly displaced in curved elongated slots 142 of first and second inner portion plates 56, 58 (the seat back motion pin 140 and curved elongated slot 142 of second inner portion plate 58 are not clearly visible in this view). This motion of seat back motion pins 140 also assists with displacement of mechanism inner portion 54 in the upward/forward displacement direction "F". It is again noted that during the displacement of mechanism inner portion 54 in the upward/forward displacement direction "F", second drive assembly 70 is not energized; therefore, the components of mechanism outer portion first and second sides 80, 82 are substantially unaffected.

Figure 7:
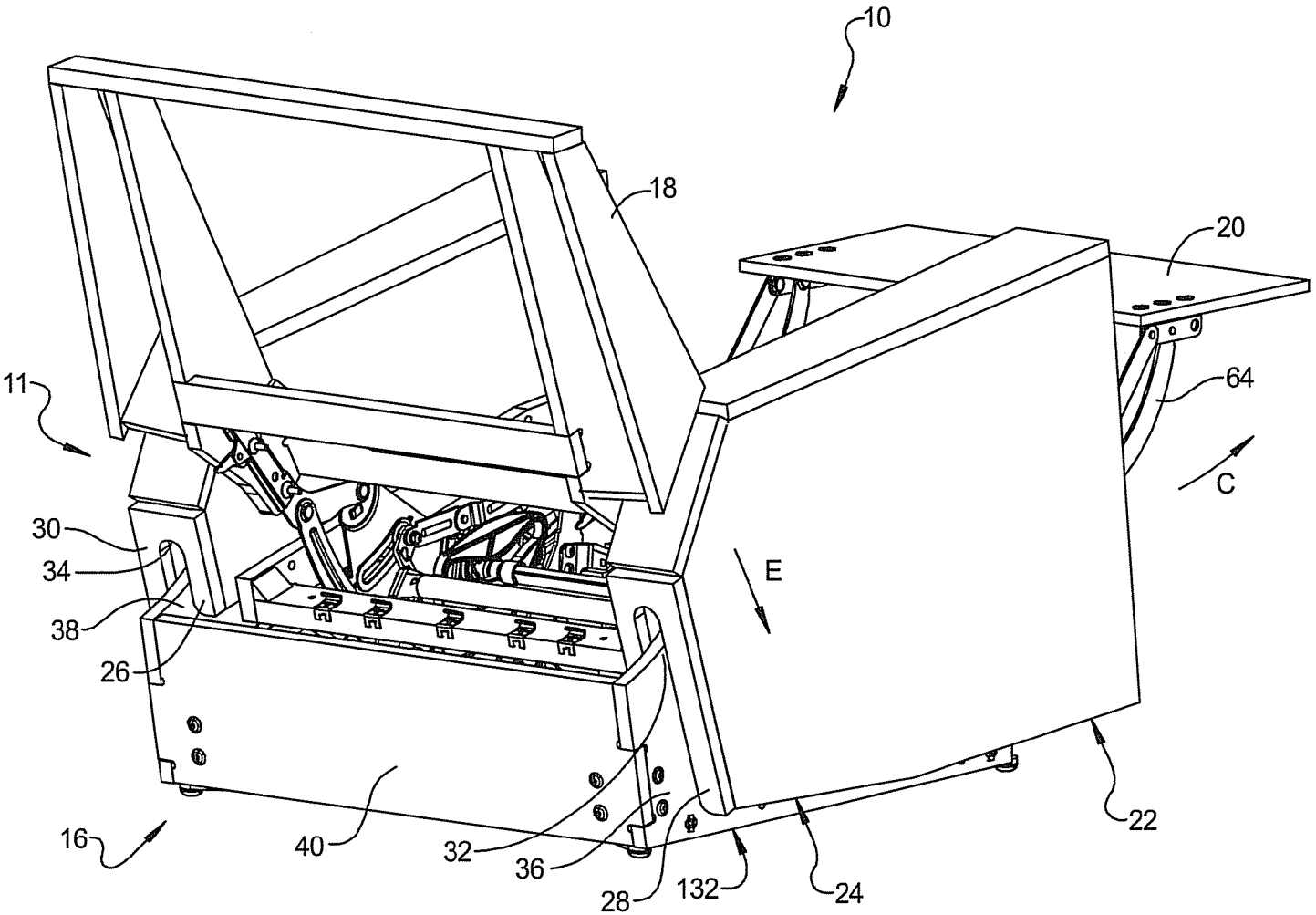
FIG. 7 is a rear right perspective view of the furniture member of FIG. 1 following displacement to a leg rest extended mechanism lowered position.

Referring to FIG. 12 and again to FIGS. 7 and 10, with furniture member 10 positioned having the leg rest member 20 in its fully extended position and seat back member 18 rotated in the upright rotation direction "B" to the fully upright position, frame structure 11 can be rotated in a frame structure rear rotation direction "G" to reach a leg rest extended zero gravity position wherein a front lower corner 143 of first and second arm members 12, 14 is elevated with respect to a rear lower corner 145 of first and second arm members 12, 14. In the leg rest extended zero gravity position, the legs of an occupant of furniture member 10 supported on leg rest member 20 are positioned substantially at an equal elevation with a waist or chest elevation of the occupant, while a head elevation of the occupant remains above the leg rest member 20. Component operation of the members of mechanism 42 to achieve the leg rest extended zero gravity position will be described in reference to FIGS. 13-15.

Figure 12:
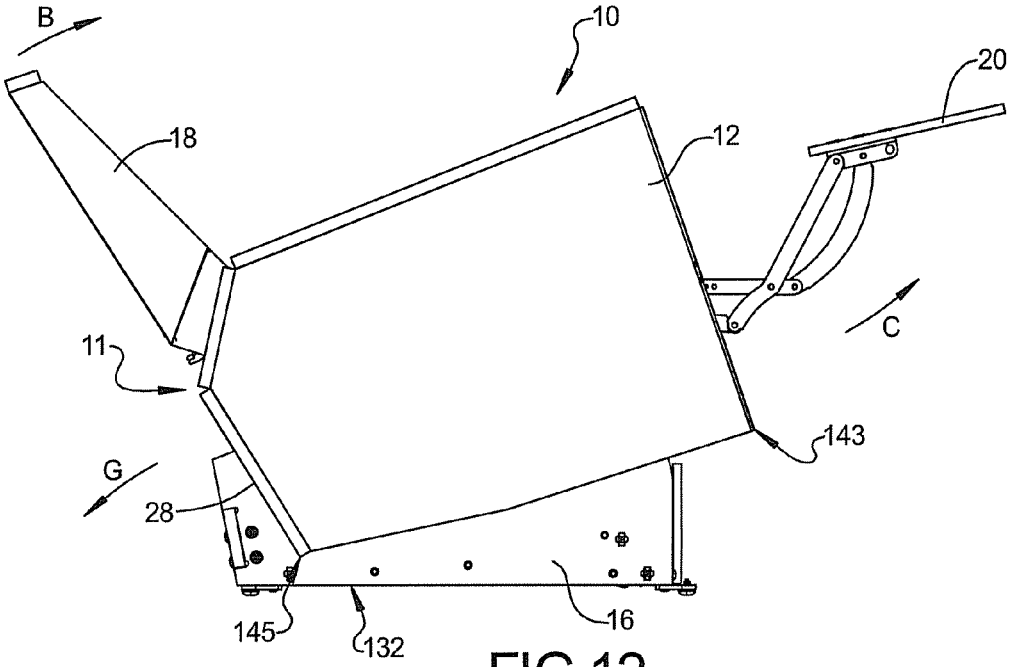
FIG. 12 is a right side elevational view of the furniture member following displacement to the leg rest extended and mechanism zero gravity position.
Figure 13:
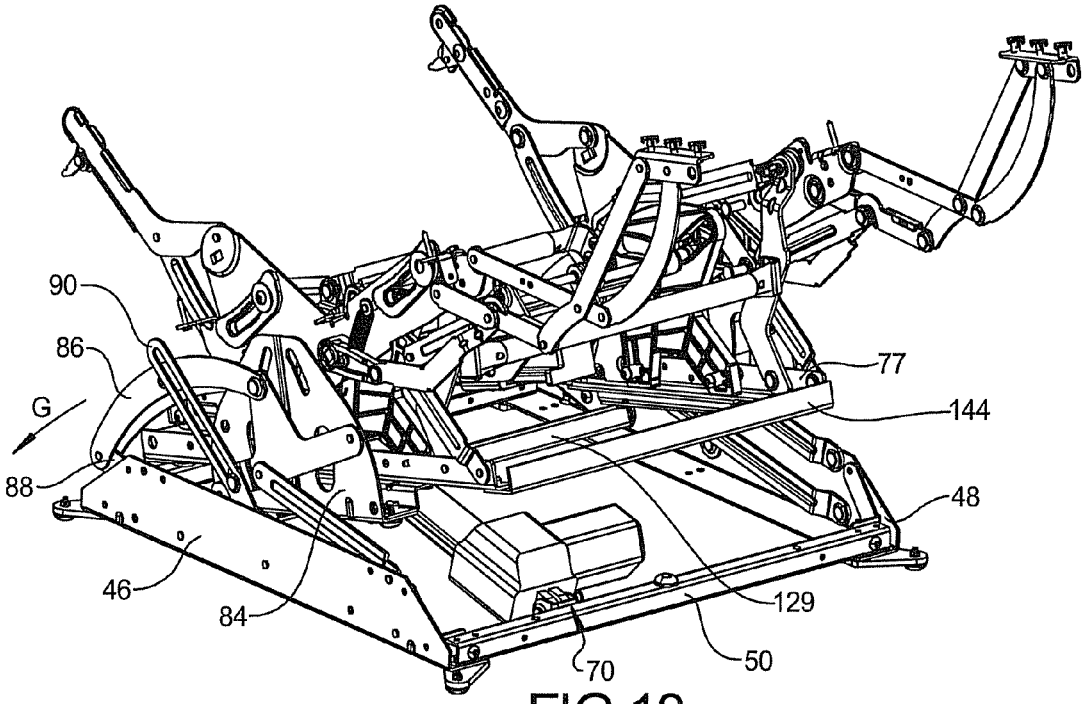
FIG. 13 is a front right perspective view of the mechanism following displacement to the leg rest extended and mechanism zero gravity position of FIG. 12.

Referring to FIG. 13, mechanism 42 is shown in the position corresponding to the leg rest extended zero gravity base position previously described with reference to FIG. 12. To achieve the leg rest extended zero gravity base position, first drive assembly 68 is de-energized and second drive assembly 70 is energized to rotate connecting shaft 129 in a substantially counterclockwise direction as viewed in FIG. 13. The counterclockwise rotation of connecting shaft 129 induces rotation of guide connecting link 88 and arc shaped guide link 86 in the frame structure rear rotation direction "G". This rotation of connecting shaft 129 results in an upward displacement of an inner portion support frame forward cross member 144 of mechanism inner portion support frame 77 with respect to support base front connector 50.

Figure 14:
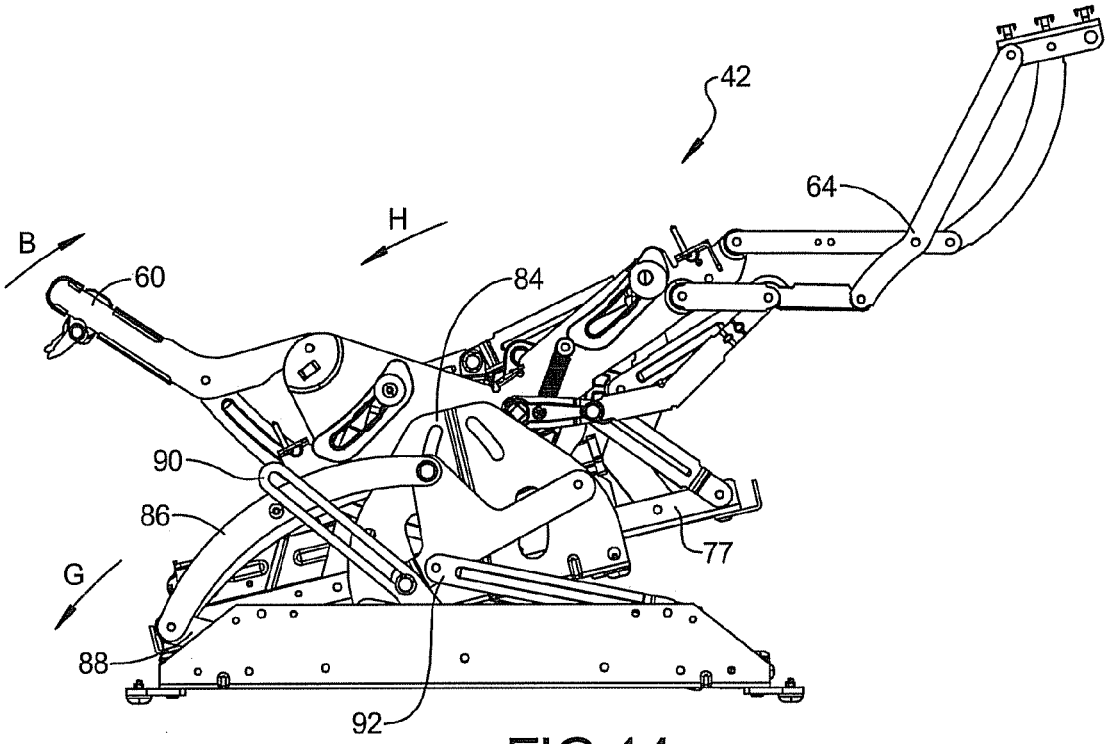
FIG. 14 is a right side elevational view of the mechanism of FIG. 13.

Referring to FIG. 14, as guide connecting link 88 and arc shaped guide link 86 are rotated in the frame structure rear rotation direction "G", lift drive plate 84 rotates in a mechanism rearward direction of rotation "H", which rotates mechanism inner portion support frame 77 and thereby further raises the end elevation of first and second pantograph linkage sets 64, 66 while lowering the position of first and second seat back support elements 60, 62. As guide connecting link 88 rotates in the frame structure rear rotation direction "G", arc shaped guide link 86 displaces rearwardly and downwardly, and each of the guide link displacement member 90 and first guide rotation link 92 rotate in an opposite or clockwise rotation, as viewed in FIG. 14.

Figure 15:
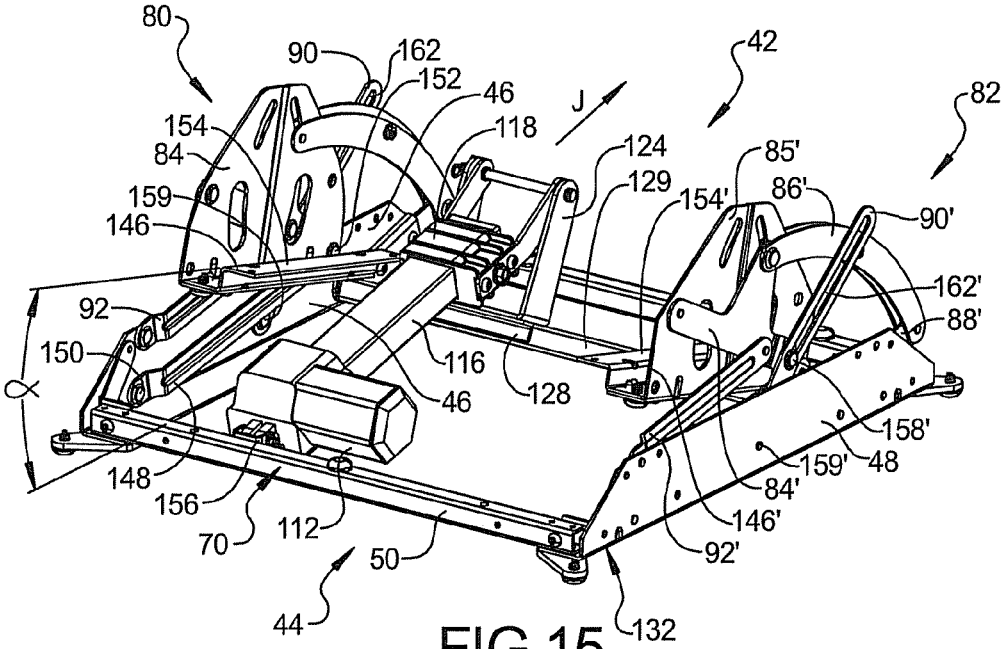
FIG. 15 is a front left perspective view modified from FIG. 14 to show only the occupant lift portion of the mechanism.

Referring to FIG. 15, with components of the mechanism inner portion 54 removed for clarity, the motions of mechanism outer portion first and second sides 80, 82 during operation of second drive assembly 70 to provide the leg rest extended zero gravity position are more easily viewed. Operation of lift drive motor 112 in a first rotation direction causes motion of the inner drive gear (not visible) within lift drive gear housing 116, which slidably displaces the sliding gear housing coupling 118 in a rearward sliding direction "J" with respect to lift drive gear housing 116. This rearward displacement of sliding gear housing coupling 118 causes a corresponding rearward rotation of coupling bracket 124 and thereby axial rotation of both rotatable connector 128 and connecting shaft 129. The resulting rearward rotation of guide connecting links 88, 88' (only guide connecting link 88' is visible in this view) results in the rearward displacement of arc shaped guide links 86, 86'. The rearward displacement of arc shaped guide links 86, 86' rotates and displaces each of lift drive plates 84, 84' and support plates 85, 85' such that plate forward ends 146, 146' of lift drive plate 84, 84' are rotated to an angle alpha ($\alpha$) representing a leg rest extended zero gravity angle defined with respect to base side bottom face 132.

With continuing reference to FIG. 15 and again to FIG. 3, during rotation and displacement of lift drive plates 84, 84', both the first guide rotation link 92 as well as a second guide rotation link 148 are also rotated with respect to rotational fasteners 150 which connect first and second guide rotation links 92, 148 to either support base first or second side 46, 48. The first and second guide rotation links 92, 148 (92', 148') are rotatably connected to lift drive plates 84, 84' using plate connection fasteners 152. The first and second guide rotation links 92, 148 (92', 148') provide rigidity and support of the weight of components and the occupant supported by a mechanism inner portion support flange 154, 154' of each of the lift drive plates 84, 84'. As both the lift drive plates 84, 84' are rotated to the angle $\alpha$, first and second mechanism inner portion support flanges 154, 154' which are connected to each of the lift drive plates 84, 84', are also rotated to the angle $\alpha$. The mechanism inner portion support frame 77, previously described in reference to FIG. 3, together with the components of mechanism inner portion 54 supported on mechanism inner portion support frame 77, are supported by the mechanism inner portion support flanges 154, 154' of each of the lift drive plates 84, 84', and therefore rotate as the mechanism inner portion support flanges 154, 154' rotate.

In order to also permit the rotation of coupling bracket 124 during operation of second drive assembly 70, second drive assembly 70 is rotatably connected to support base front connector 50 using a rotation joint 156. This allows a lift drive gear housing 116 angular orientation to vary with respect to base side bottom face 132. A slide fastener 158 slidably couples each of the guide link displacement members 90, 90' to one of the arc shaped guide links 86, 86'. A lower end of the guide link displacement members 90, 90' (only the lower end of guide link displacement member 90 is visible in this view) are rotatably connected to support base first or second sides 46, 48. A longitudinal slot 162, 162' is created in each of the guide link displacement members 90, 90' to slidably receive slide fasteners 158, 158'. As coupling bracket 124 rotates rearwardly, the arc shaped guide links 86, 86' rotate and displace, and the slide fastener 158 remains in contact with a slot end wall of the longitudinal slots 162, 162' created in each of the guide link displacement members 90, 90' to provide for occupant support at the zero gravity position.

Figure 16:
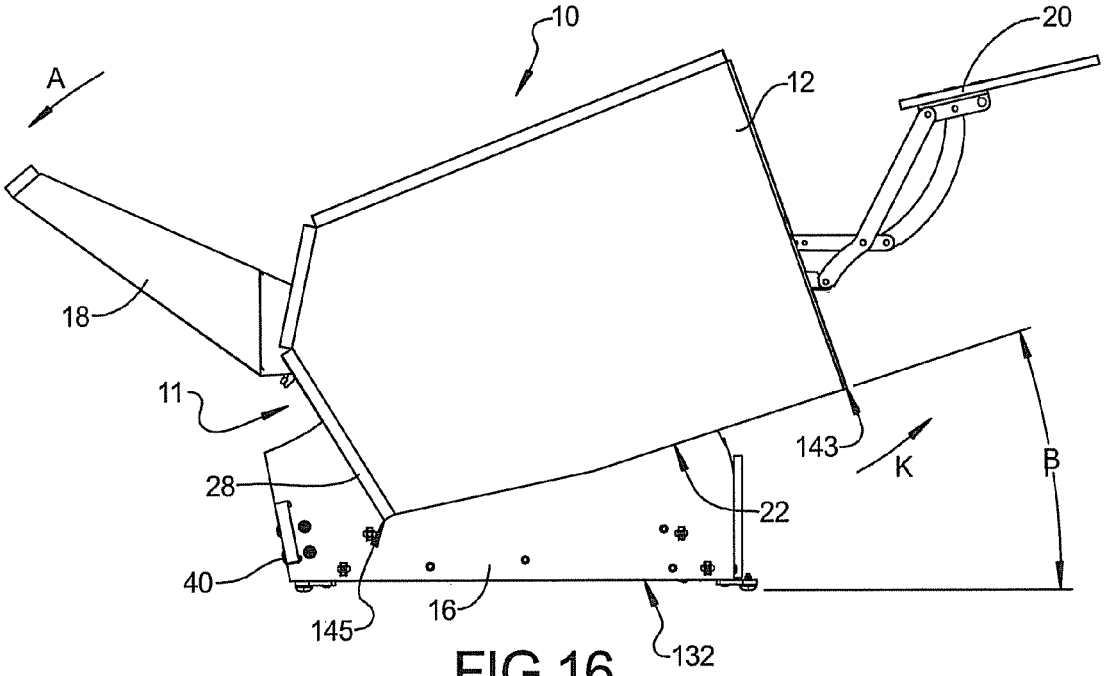
FIG. 16 is a right side elevational view of the furniture member following displacement to the leg rest extended, seat back fully reclined, and mechanism zero gravity position.

Referring to FIG. 16, following movement to the leg rest extended zero gravity position, furniture member 10 can be further repositioned by rotating seat back member 18 to its fully reclined position such that frame structure 11 is positioned in a leg rest fully extended and seat back fully reclined second zero gravity position. In the second zero gravity position, both front lower corner 143 and rear lower corner 145 are elevated with respect to the leg rest extended first zero gravity position shown and described in reference to FIG. 12. In the second zero gravity position, a fully reclined zero gravity angle beta (β) is created between first arm bottom face 22 and the planar surface defined by base side bottom face 132. According to several embodiments, fully reclined zero gravity angle β is greater than the leg rest extended zero gravity angle α shown and described in reference to FIG. 15. To reach the second zero gravity position, frame structure 11 is rotated with respect to an arm member forward arc of rotation "K" as the seat back member 18 rotates in the reclining direction "A". Also in the second zero gravity position, first extending piece wing 28 is displaced further forward with respect to rear base side connecting piece 40.

Figure 17:
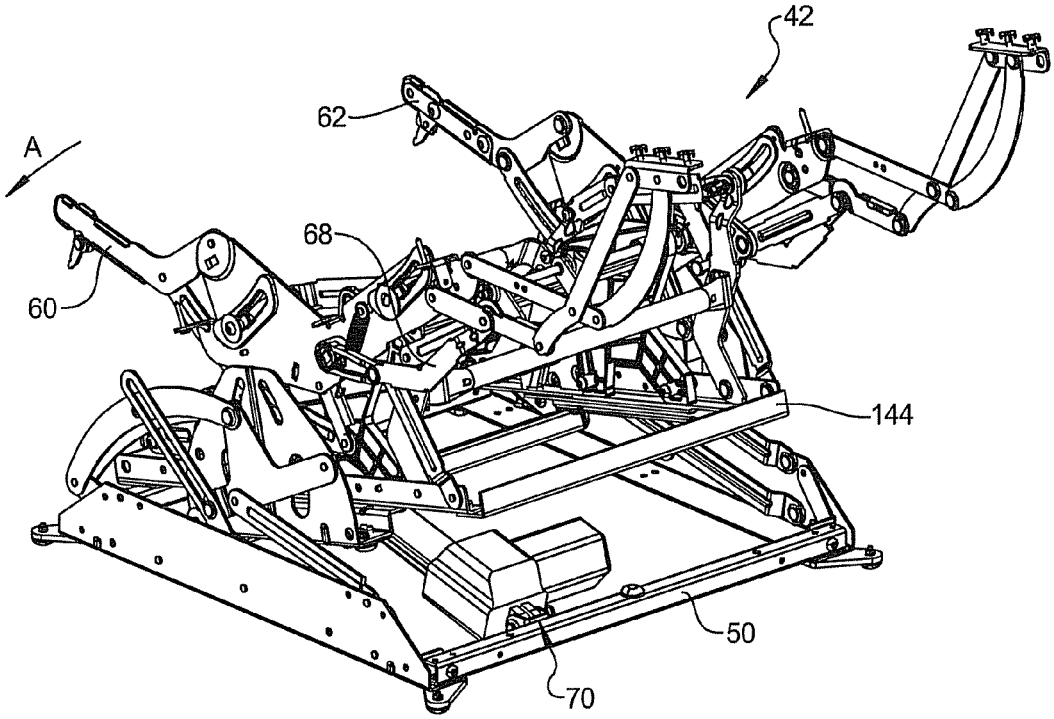
FIG. 17 is a front right perspective view of the mechanism following displacement to the leg rest extended, seat back fully reclined, and mechanism zero gravity position of FIG. 16.

Referring to FIG. 17, mechanism 42 is shown following displacement to the fully reclined second zero gravity position described with respect to FIG. 16. Both of the first and second seat back support elements 60, 62 are positioned in the furthest reclined position after movement in the receiving direction "A", and inner portion support frame forward cross member 144 is elevated with respect to support base front connector 50. To move from the first to the second zero gravity positions, second drive assembly 70 is de-energized and first drive assembly 68 is energized to rotate first and second seat back support elements 60, 62 to their fully reclined positions.

Figure 18:
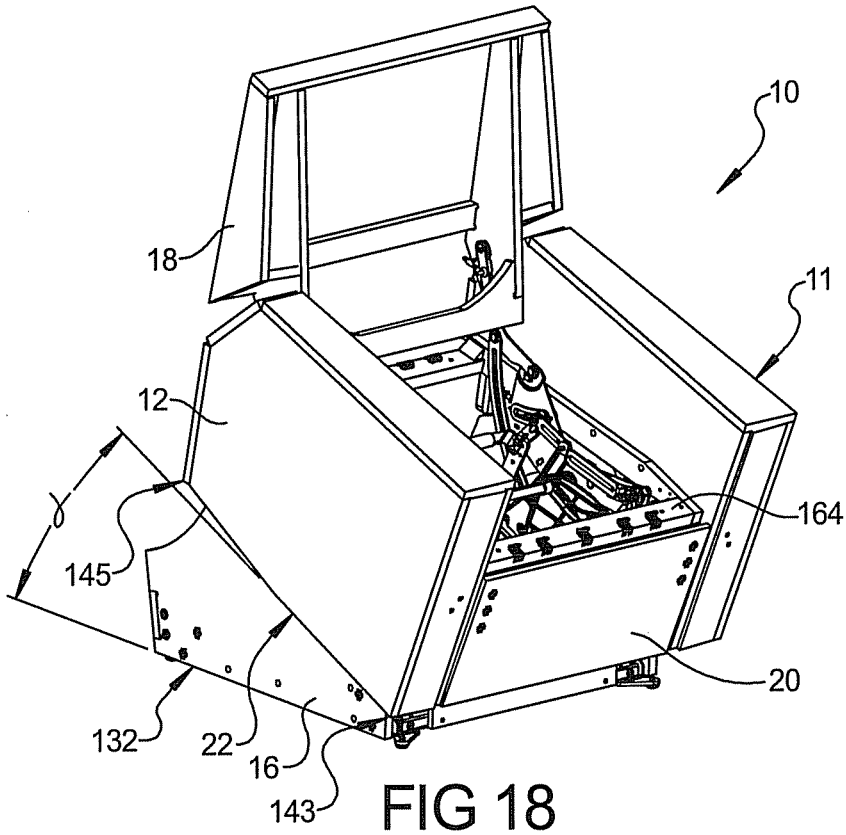
FIG. 18 is a front right perspective view of the furniture member following displacement to a fully raised position.

Referring to FIG. 18, with seat back member 18 in the fully forward position and leg rest member 20 in the fully retracted or stowed position, frame structure 11 can be rotated forward to an occupant lift position defining a lift base fully raised angle gamma (γ) between first arm bottom face 22 and the plane defined by base side bottom face 132. The lift base fully raised angle γ is selected to assist occupants who are seated on furniture member 10 to return to a standing position by powered rotation of frame structure 11. In the fully raised or lifted position of frame structure 11, the elevation of front lower corner 143 is repositioned to be lower than an elevation of rear lower corner 145. This also assists, together with lift base fully raised angle γ, for lowering the feet position of the occupant for standing. The occupant's weight and center of gravity which is supported on a seat pan with respect to an occupant support pan frame 164 is moved forwardly and upwardly as occupant support pan frame 164 rotates together with frame structure 11. During the forward rotation to lift base fully raised angle γ, frame structure 11 rotates while base member 16 remains fixed in position with respect to the floor surface.

Referring to FIG. 19 and again to FIG. 18, in the fully raised occupant lift position of furniture member 10, the first and second base sides 36, 38 of base member 16 vacate the first and second wing cavities 32, 34, and an open cavity 166 between arm member extending piece 26 and rear base side connecting piece 40 is created. None of the members of frame structure 11 or base member 16 cover or preclude access via open cavity 166. Open cavity 166 can be covered by an upholstery member (not shown), such as a flexible cloth cover, to cover the working components of mechanism 42.

Figure 19:
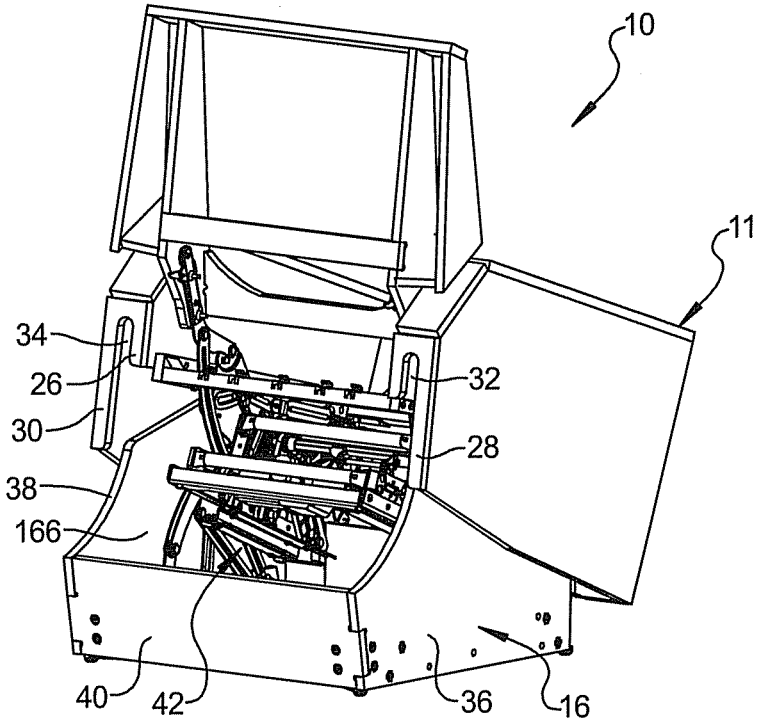
FIG. 19 is a rear right perspective view of the furniture member of FIG. 18.

Referring to FIG. 20 and again to FIGS. 18 and 19, mechanism 42 is shown following the full extension to the fully raised or occupant lift position. Prior to movement toward the occupant lift position, first and second seat back support elements 60, 62, if rotated away from their upright positions, are initially re-positioned in their fully upright position by rotation in upright rotation direction "B". Following any necessary displacement of first and second seat back support elements 60, 62, both first and second pantograph linkage sets 64, 66, if extended, are subsequently and sequentially repositioned to their fully retracted or stowed position. First drive assembly 68 is operated during this phase of the operation.

To then reach the fully raised position, second drive assembly 70 is operated to rotate each of the guide connecting links 88, 88' to a substantially upright position, thereby maximizing an elevation of the arc shaped guide links 86, 86'. The inner portion support frame forward cross member 144 is positioned proximate to support base front connector 50, while the lower rear cross support member 96 is positioned at a maximum elevation with respect to base side bottom face 132.

Figure 20:
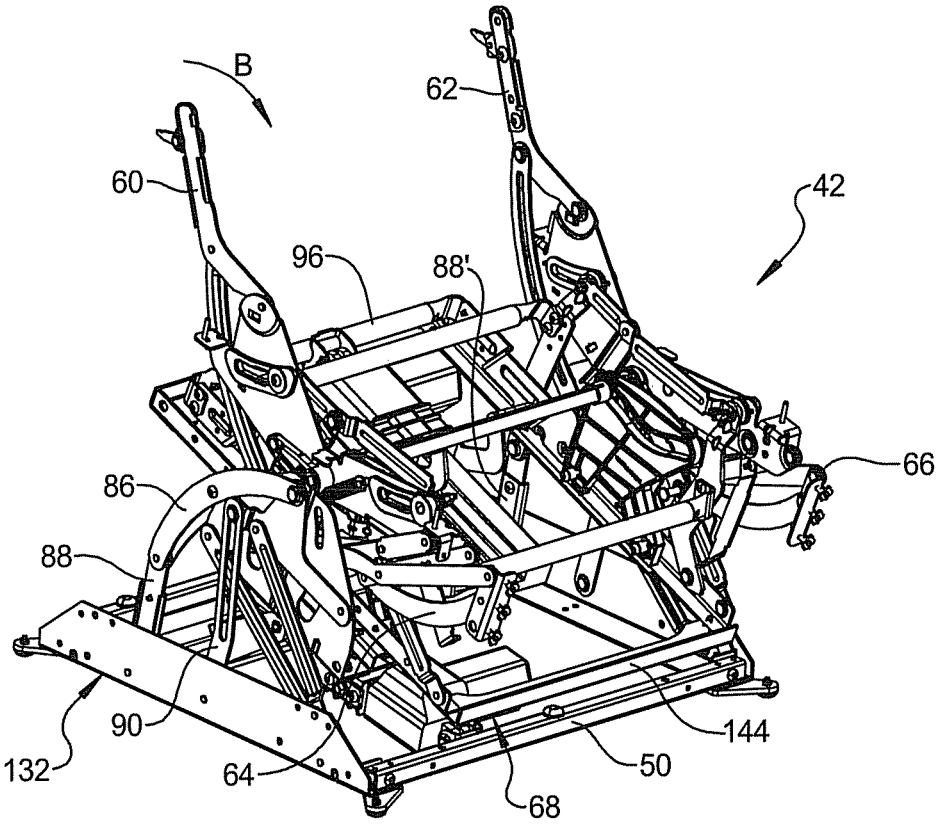
FIG. 20 is a front right perspective view of the mechanism following displacement to the fully raised position.

Referring to FIG. 21 and again to FIG. 20, an inner portion support frame rear cross member 168 is moved to a maximum elevation with respect to support base rear connector 78 in the fully raised position of mechanism 42. Displacement or motion of any of the components of mechanism inner portion 54 does not occur during the displacement to the fully raised position when second drive assembly 70 is in operation. It is also noted that lift drive motor 112 of second drive assembly 70 is operated in an opposite rotation direction with respect to the operating rotation direction used to reach the zero gravity positions previously described herein.

Figure 21:
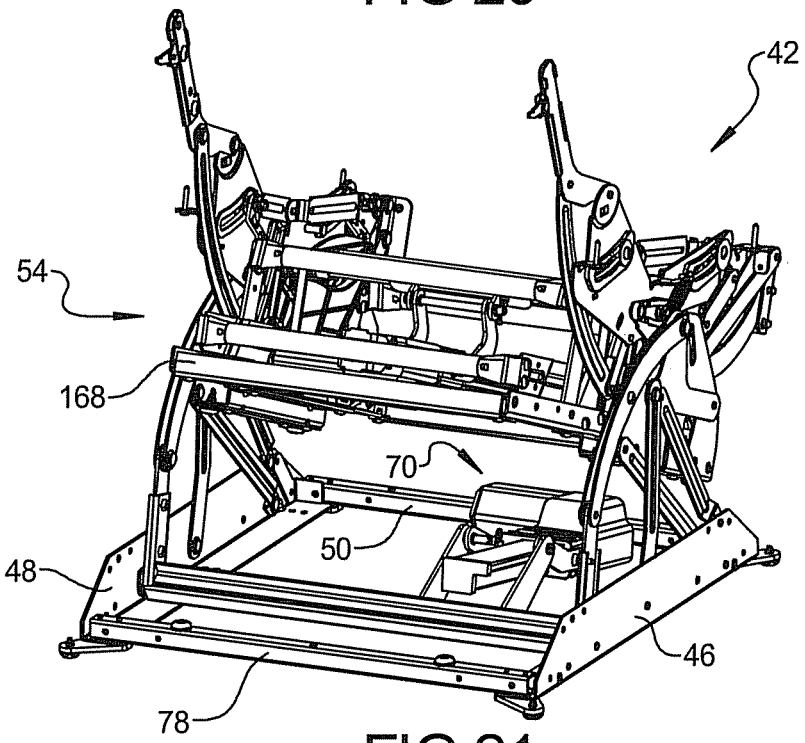
FIG. 21 is a rear right perspective view of the mechanism of FIG. 20.
Figure 22:
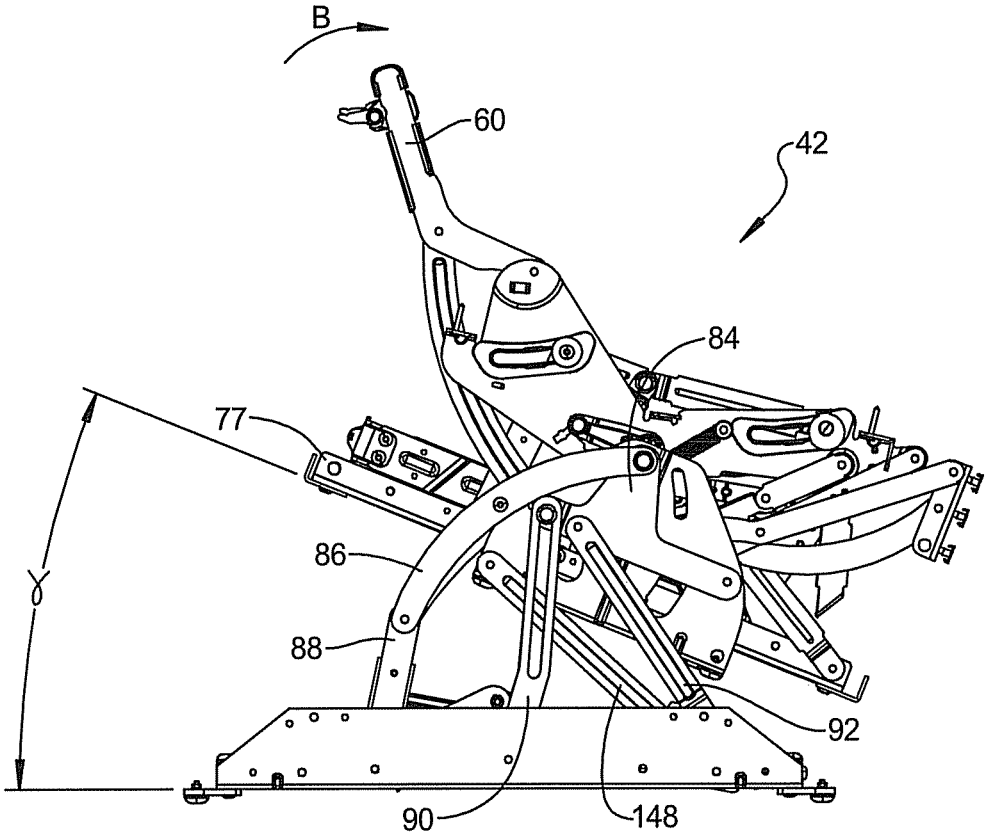
FIG. 22 is a right side elevational view of the mechanism of FIG. 20.

Referring to FIG. 22 and again to FIGS. 20 and 21, when reaching the fully raised occupant lift position of mechanism 42, the guide link displacement member 90 is oriented substantially vertically, and both the first and second guide rotating links 92, 148 are upwardly rotated to a maximum degree. The mechanism inner portion support frame 77 is also oriented at lift base fully raised angle gamma (γ).

Figure 23:
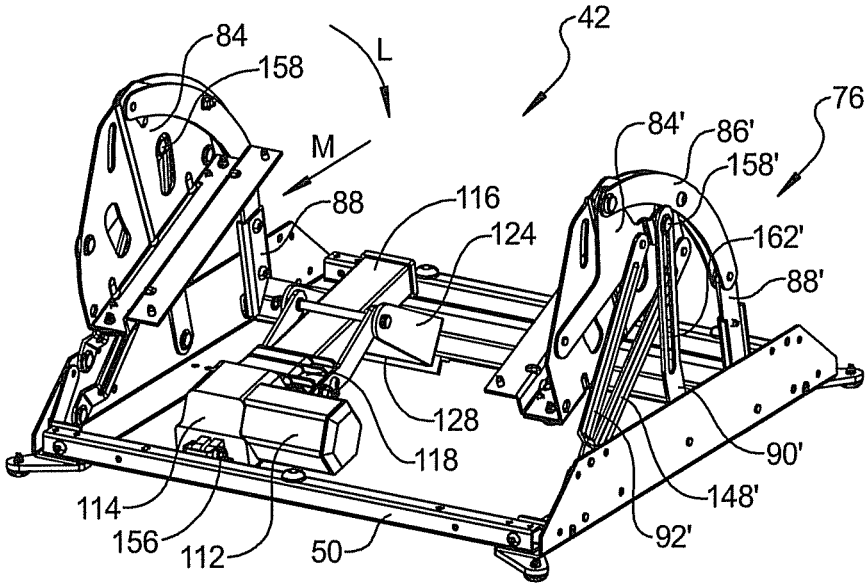
FIG. 23 is a front left perspective view modified from FIG. 22 to show only the occupant lift portion of the mechanism.

Referring to FIG. 23, to reach the fully raised or occupant lift position of mechanism 42, lift drive motor 112 is energized to rotate the gear or other drive mechanism (not shown) of lift drive gear housing 116 to rotate lift drive gear housing 116 in a gear housing downward arc of rotation "L" and to slidably displace sliding gear housing coupling 118 in a forward direction "M". This longitudinal motion of sliding gear housing coupling 118 rotates coupling bracket 124 in a forward direction, which rotates rotatable connector 128 and thereby axially rotates connecting shaft 129 to induce rotation of guide connecting links 88, 88'. As the guide connecting links 88, 88' reach the substantially upright orientations shown, the slide fasteners 158, 158' connected to each of the lift drive plates 84, 84' extend within the longitudinal slots 162, 162' to a maximum upward extension end of the longitudinal slots 162, 162', thereby limiting further rotation of guide connecting links 88, 88'. This maximum rotation of mechanism 42 can also be reached when sliding gear housing coupling 118 contacts lift drive assembly 114.

Figure 24:
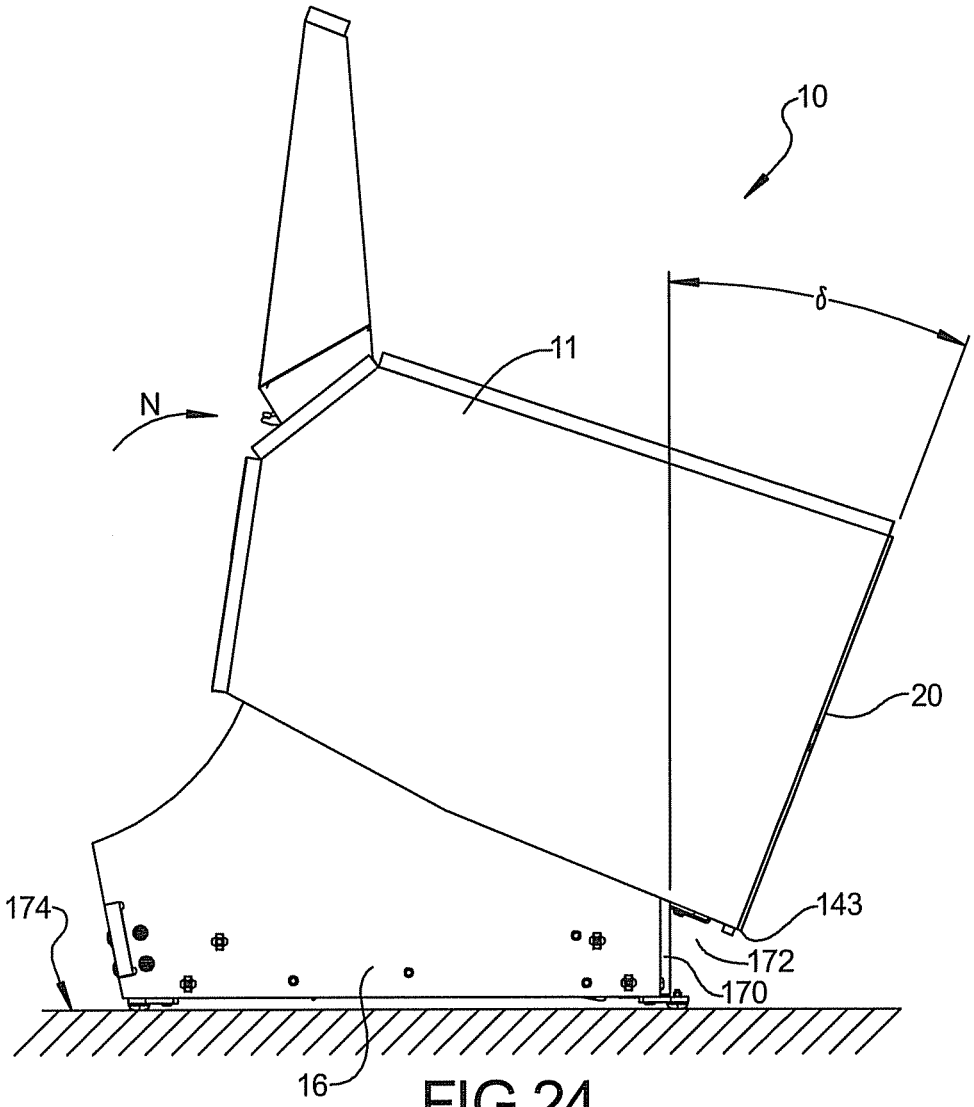
FIG. 24 is a right side elevational view of the furniture member of FIG. 18.

Referring to FIG. 24 and again to FIGS. 18-23, furniture member 10 is moved to the fully raised or occupant lift position by operation of second drive assembly 70 which rotates frame structure 11 in a forward arc of rotation "N". In the occupant lift position the fully retracted leg rest member 20 defines an angle delta (6) with respect to a front base side connecting piece 170 of base member 16. According to several embodiments angle δ can range from approximately 10 degrees to approximately 45 degrees or greater. Because the leg rest member 20 is connected to and therefore moves together with frame structure 11, leg rest member 20 is also displaced forward of front base side connecting piece 170. This forward displacement creates a cavity 172 between the front lower corner 143, the front base side connecting piece 170, and a planar surface 174 such as a floor upon which furniture member 10 is standing. A combination of angle δ which permits the lower legs of the occupant to be angled rearward, and cavity 172 which permits the feet of the occupant to be brought under the front lower corner 143, together advantageously promote occupant egress from furniture member 10, in particular when compared to furniture members where the leg rest member is in line with the front base side connecting piece of the base member.

Referring to FIG. 25 and again to FIGS. 1, 2, and 6, a rear rotated position is reached by operation of second drive assembly 70 rotating frame structure 11 with respect to base member 16 in mechanism rearward direction of rotation "H", with leg rest member 20 in its stowed position and seat back member 16 in its fully upright position. This rearward rotation positions rear lower corner 145 of frame structure 11 below front lower corner 143.

Referring to FIG. 26 and again to FIGS. 3-6 and 25, in the rearward rotated position of mechanism 42 guide connecting link 88 rotates counterclockwise as viewed in FIG. 26 which rotates arc shaped guide link 86 counterclockwise and rearward, thereby rotating mechanism inner portion support frame 77 such that inner portion support frame forward cross member 144 is lifted above guide connecting link 88. First pantograph linkage set 64 is positioned in its retracted position, and first seat back support element 60 is positioned in the upright position. Operation of first drive assembly 68 is not required to reach this position of mechanism 42.

Referring to FIG. 27 and again to FIGS. 3-6 and FIGS. 25-26, operation of lift drive motor 112 and lift drive assembly 114 of second drive assembly 70 displaces sliding gear housing coupling 118 rearward, which rotates coupling bracket 124 and thereby connecting shaft 129 to rearwardly rotate first and second guide connecting links 88, 88'. The rearward rotated orientations of first and second mechanism inner portion support flanges 154, 154' are maintained until second drive assembly 70 is again operated to oppositely axially rotate connecting shaft 129.

Figure 28:
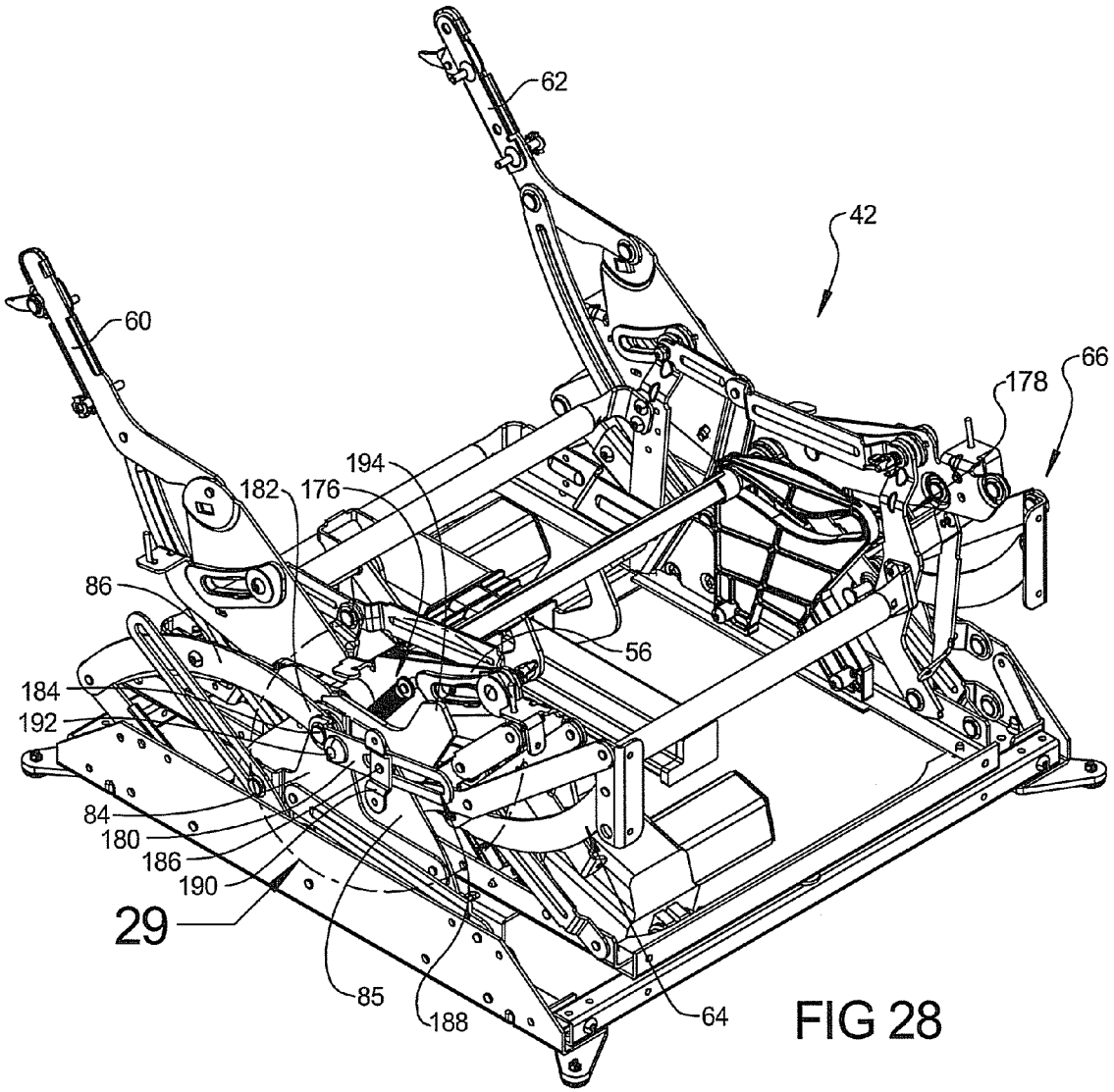
FIG. 28 is a front right perspective view of the mechanism of FIG. 3 modified to include right and left side-to-side stabilizing systems for the mechanism.

Referring to FIG. 28 and again to FIG. 2, according to several embodiments mechanism 42 can further include mirror image right and left side-to-side stabilizing systems 176, 178 (only right side-to-side stabilizing system 176 is clearly visible in this view). Because each of the right and left side-to-side stabilizing systems 176, 178 are mirror image configurations having the same components, only right side-to-side stabilizing system 176 will be further described. Right side-to-side stabilizing system 176 includes a slotted link 180 rotatably connected to both lift drive plate 84 and an inward end 182 of arc shaped guide link 86 using a rotational fastener 184. As slotted link 180 rotates with respect to rotational fastener 184, a slide pin 186 is slidably displaced within an elongated slot 188 of slotted link 180. Slide pin 186 is rotatably connected to a fixed link 190 which is fixed such as by fastening to first base side 36 of base member 16. Fixed link 190 therefore remains in the position shown in FIG. 28 during subsequent motion of frame structure 11. The slide pin 186 limits a displacement of the slotted link 180 as the slotted link 180 moves during rotation of the mechanism 42.

A polymeric material glide member or glide 192 is fixed to and extends outwardly away from slotted link 180. Glide 192 maintains a spacing between the components of right side-to-side stabilizing system 176 and an inner face of first base side 36 while also permitting sliding motion between glide 192 and the inner face of the inner face of first base side 36. Right side-to-side stabilizing system 176 further includes a polymeric material guide plate 194 positioned between support plate 85, the inner portion plate 56 and an inner portion of guide link 86 to prevent contact with the various moving links of mechanism 42.

Figure 29:
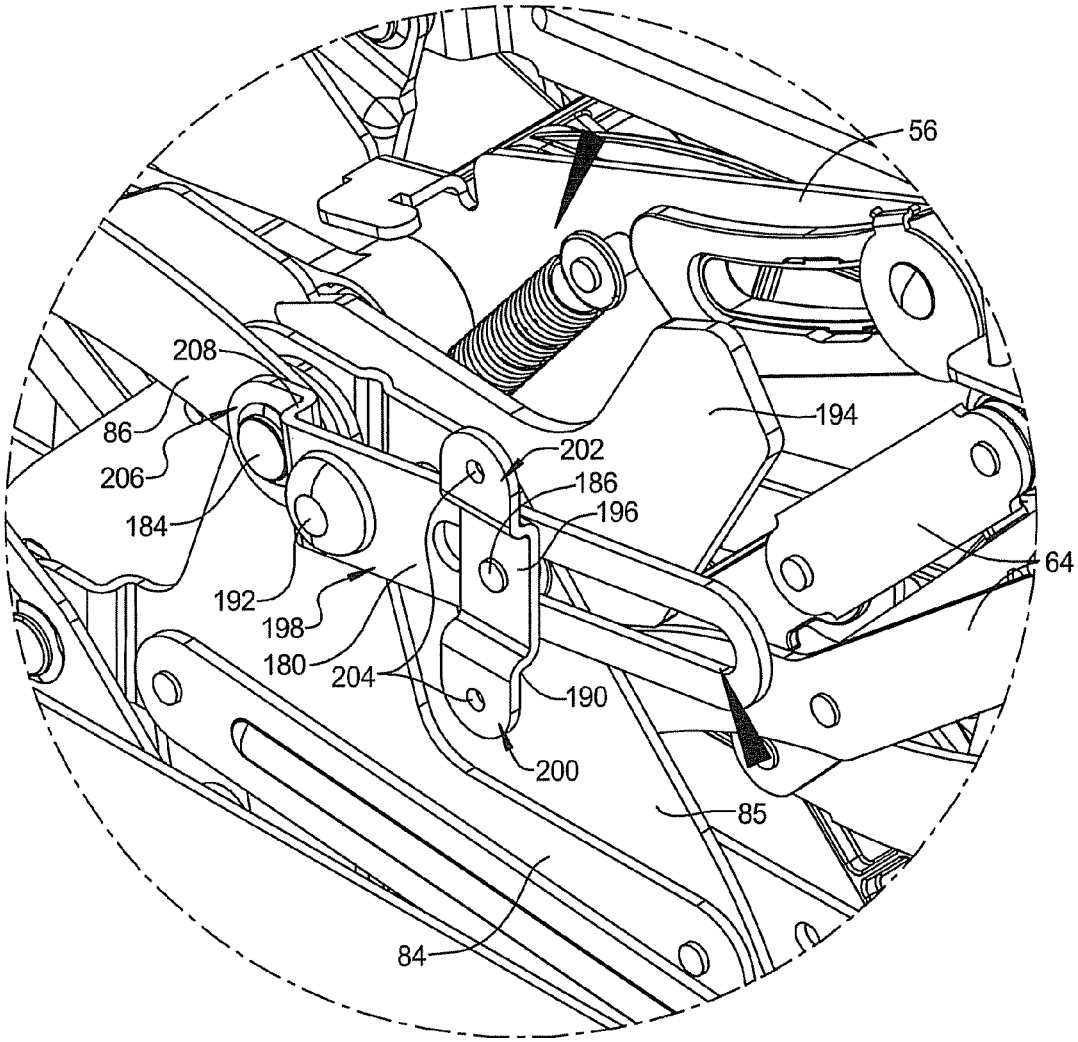
FIG. 29 is a front right perspective view of area 29 of FIG. 28.

Referring to FIG. 29 and again to FIG. 2, fixed link 190 includes a planar central portion 196 that slides with respect to a planar surface 198 of slotted link 180. Fixed link 190 also includes opposed first and second flange ends 200, 202 which are raised with respect to planar central portion 196 and therefore also with respect to planar surface 198 thereby extending outwardly away from planar central portion 196 to provide clearance for slide pin 186 and to extend outwardly to contact first base side 36 of base member 16. Apertures 204 created through both first and second flange ends 200, 202 provide for fasteners (not shown) that connect fixed link 190 to first base side 36 of base member 16. Extending inwardly with respect to planar surface 198 is a flange member 206 of slotted link 180. Flange member 206 receives rotational fastener 184 and is in direct contact with and rotates with respect to arc shaped guide link 86 and also rotates with respect to lift drive plate 84. A stepped wall 208 spatially separates flange member 206 from planar surface 198 to provide rotational clearance for rotational fastener 184 and additional spacing for planar surface 198.

Referring to FIG. 30 and again to FIG. 4, with mechanism 42 in the retracted position having pantograph linkage set 62 in the fully retracted position and first seat back support element 60 in its upright position, slide pin 186 is positioned proximate to but not in direct contact with a first end wall 210 of elongated slot 188. Slotted link 180 is either oriented substantially horizontal in this orientation of mechanism 42, or can have elongated slot 188 oriented at a small angle (approximately 0 to 10 degrees) with rotational fastener 184 defining a low end of slotted link 180 and elongated slot 188 angled upwardly with respect to support base first side 46.

Figure 30:
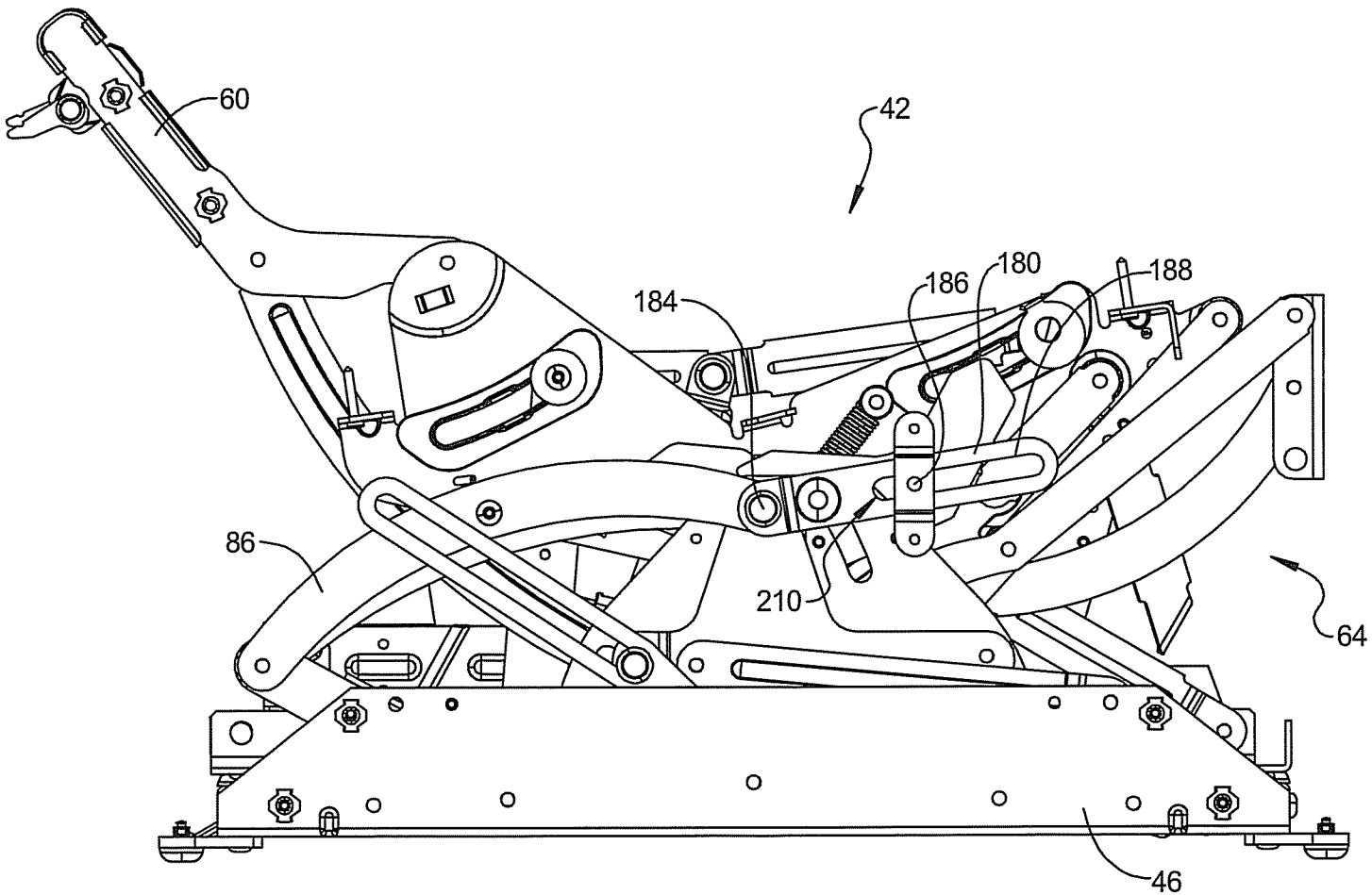
FIG. 30 is a right side elevational view of the mechanism of FIG. 28.
Figure 31:
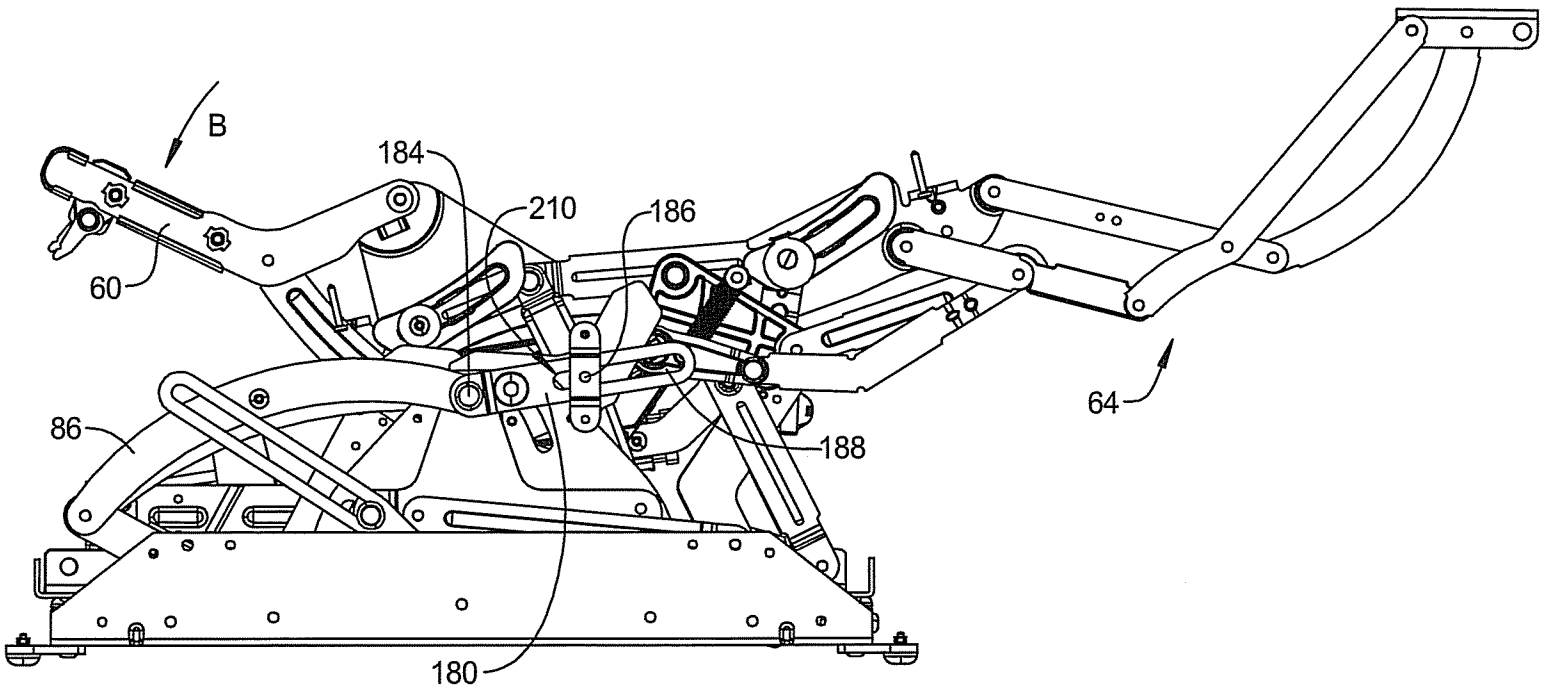
FIG. 31 is a right side elevational view of the mechanism of FIG. 3 following displacement to the leg rest extended mechanism lowered position.

Referring to FIG. 31 and again to FIG. 30, mechanism 42 is shown after pantograph linkage set 62 is moved to its fully extended position and seat back support element 60 is rotated to its fully reclined position. The orientation of slotted link 180 is substantially the same in this position of mechanism 42 as that shown in FIG. 30 when the mechanism 42 is in the retracted position.

Figure 25:
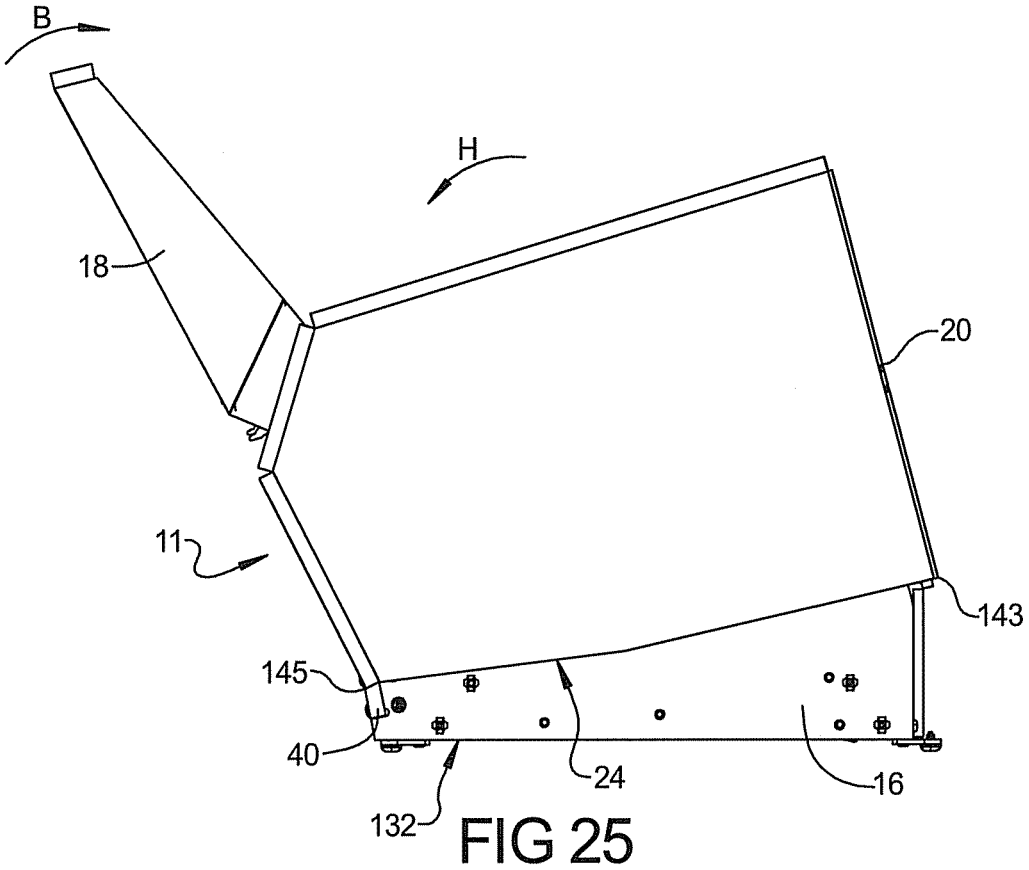
FIG. 25 is a right side elevational view of the furniture member rotated rearward to a zero gravity position.
Figure 26:
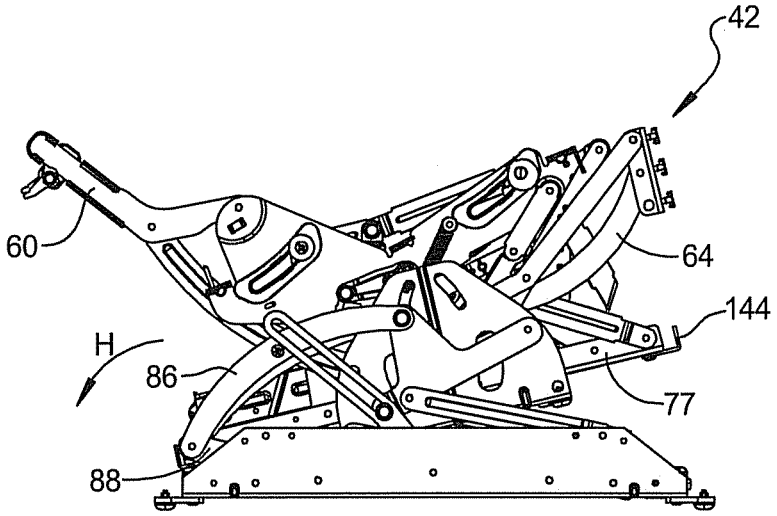
FIG. 26 is a right side elevational view of the mechanism rotated rearward to the zero gravity position.
Figure 27:
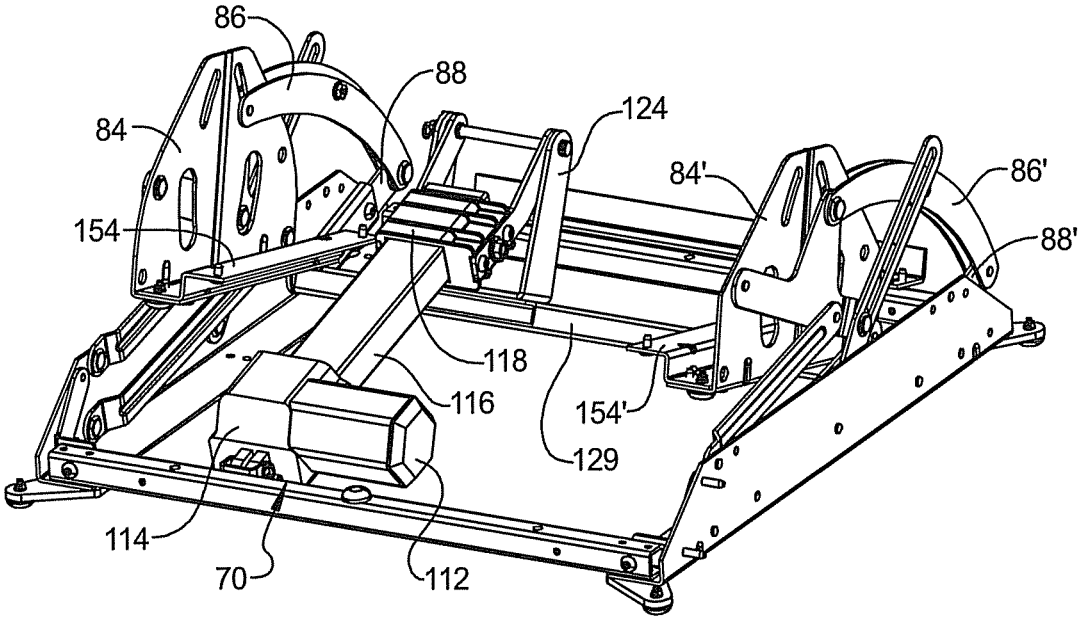
FIG. 27 is a front left perspective view modified from FIG. 26 to show only the occupant lift portion of the mechanism in the zero gravity position.
Figure 32:
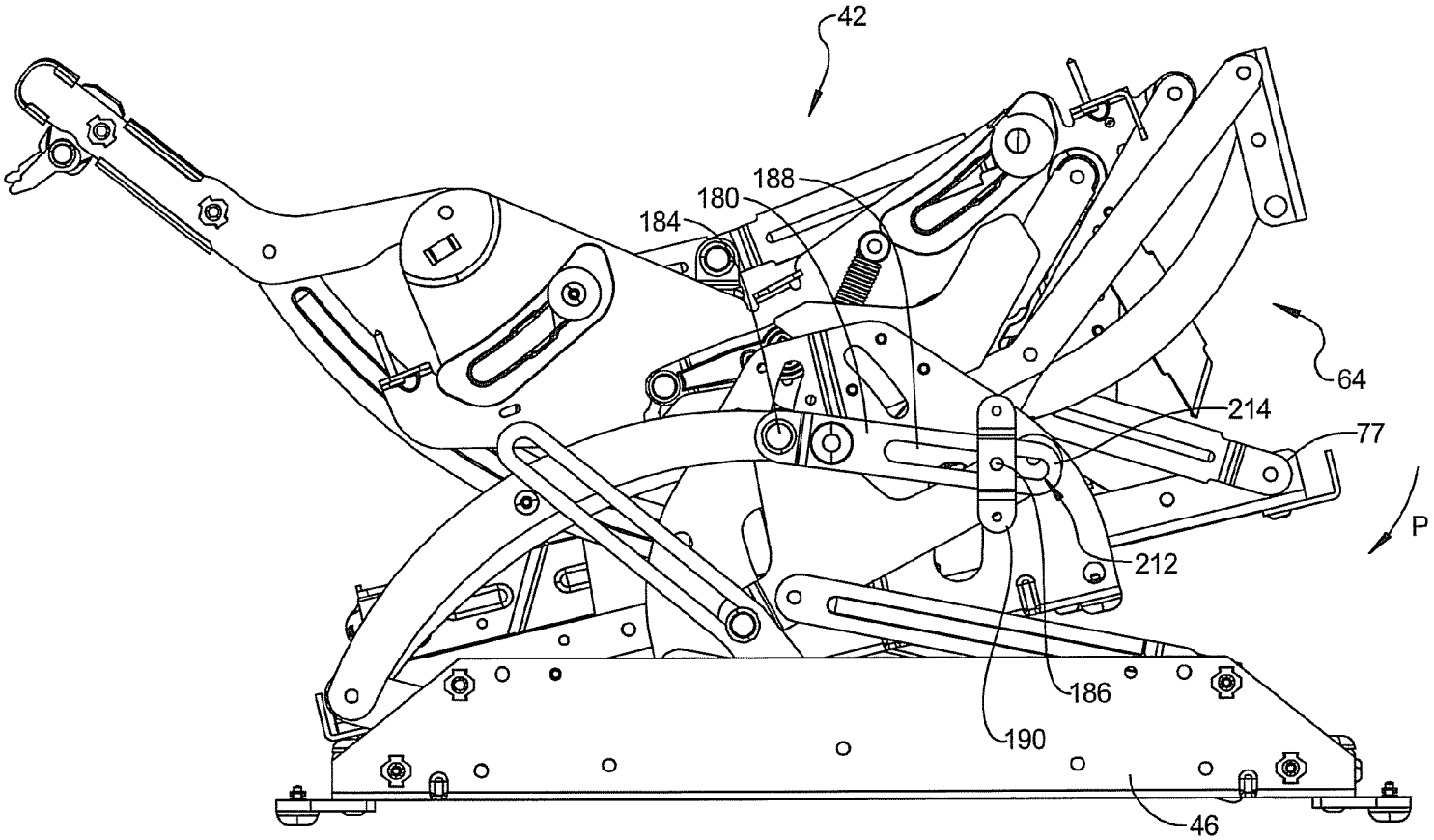
FIG. 32 is a front right perspective view of the mechanism of FIG. 28 rotated rearward to the mechanism zero gravity position.

Referring to FIG. 32 and again to FIGS. 25 and 26, mechanism 42 is shown following motion to its rearwardly rotated zero gravity position previously described herein. Because the position of fixed link 190 does not move during this transition, slotted link 180 displaces rearwardly, displacing slide pin 186 forward toward a second end wall 212 of elongated slot 188. A free end 214 of slotted link 180 rotates downwardly about an arc of rotation "P" with respect to an axis of rotation of rotational fastener 184. Slotted link 180 rotates in the arc of rotation "P" until elongated slot 188 is oriented at a small downward angle (approximately 0 to 10 degrees) with respect to rotational fastener 184 with rotational fastener 184 defining a high end of slotted link 180 and elongated slot 188 angled downwardly toward mechanism inner portion support frame 77.

Figure 33:
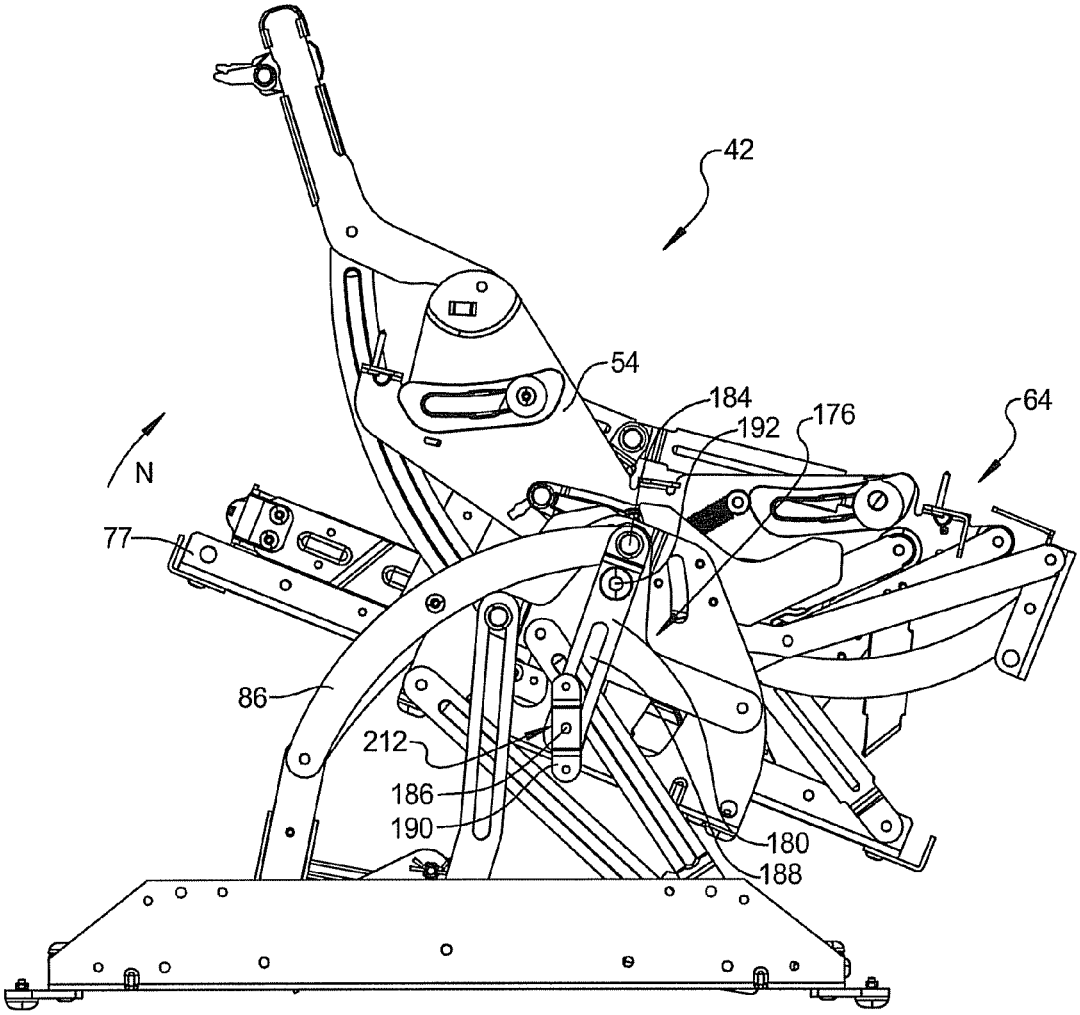
FIG. 33 is a right side elevational view of the mechanism of FIG. 28 following displacement to the fully raised position.

Referring to FIG. 33 and again to FIGS. 18-24, mechanism 42 is shown following movement to the fully raised or occupant lift position by operation of second drive assembly 70 which rotates frame structure 11 and therefore co-rotates mechanism inner portion 54 in a forward arc of rotation "N". As arc shaped guide link 86 is rotated to the position shown, rotational fastener 184 is displaced to its furthest forward and highest elevated position. Slide pin 186 is displaced toward second end wall 212 within elongated slot 188 of slotted link 180. Contact between slide pin 186 and second end wall 212 at the occupant lift position helps to stabilize mechanism 42 by minimizing or eliminating rocking motion of mechanism 42 as the furniture member occupant either sits down or stands and moves away. The fixed link 190, the glide 192 and the guide plate 194 and of right and left side-to-side stabilizing systems 176, 178 (left side-to-side stabilizing system 178 is not clearly visible in this view) also limit or eliminate side-to-side deflection of mechanism 42 by providing contact points between the components of mechanism 42 and the first and second base sides 36, 38 of base member 16. The polymeric material of glide 192 and guide plate 194 minimize friction at the contact points as the mechanism 42 moves to any of its operating positions.

Figure 34:
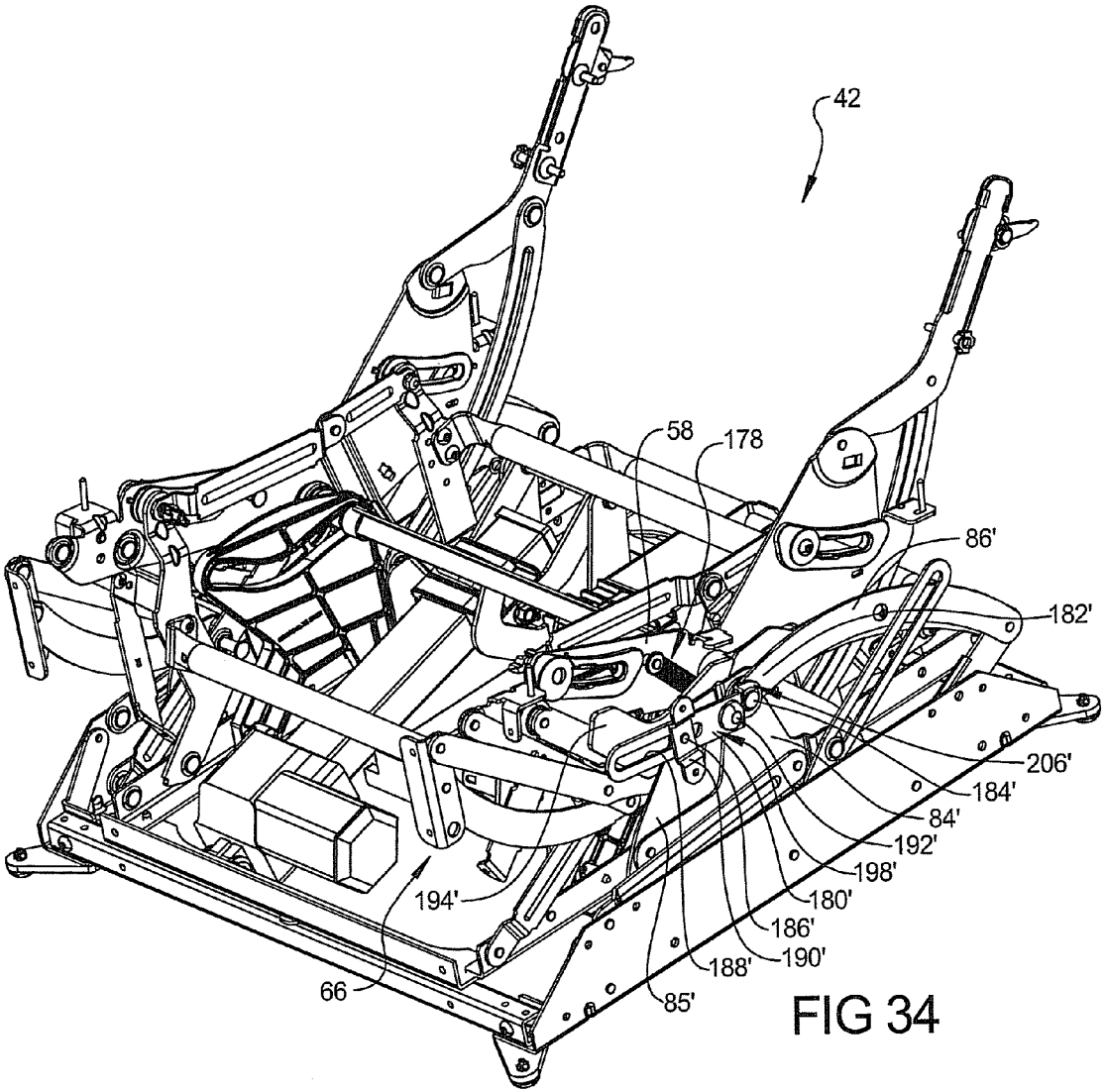
FIG. 34 is a front left perspective view similar to FIG. 28.

Referring to FIG. 34 and again to FIG. 2, the mirror image configuration of left side-to-side stabilizing system 178 is shown with prime part numbers of components of left side-to-side stabilizing system 178 defining equivalent but opposite hand configurations of the components of right side-to-side stabilizing system 176. Left side-to-side stabilizing system 178 therefore includes a slotted link 180' rotatably connected to both lift drive plate 84' and an inward end 182' of arc shaped guide link 86' using a rotational fastener 184'. As slotted link 180' rotates with respect to rotational fastener 184', a slide pin 186' is slidably displaced within an elongated slot 188' (not clearly visible in this view) of slotted link 180'. Slide pin 186' is rotatably connected to a fixed link 190'. A polymeric material glide member or glide 192' is fixed to and extends outwardly away from slotted link 180'. Glide 192' maintains spacing between the components of left side-to-side stabilizing system 178 and an inner face of second base side 38 while also permitting sliding motion between glide 192' and the inner face of second base side 38. Left side-to-side stabilizing system 178 further includes a polymeric material guide plate 194' positioned between support plate 85', the inner portion plate 58 and the inner portion of guide link 86' to prevent contact with the various moving links of mechanism 42.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A furniture member providing powered occupant lift, comprising:

a mechanism, including:

a mechanism support base configured to rest on a floor;

a mechanism inner portion support frame movably connected to the mechanism support base by a plurality of links;

a mechanism inner portion configured for reclination of the furniture member, the mechanism inner portion carried on the mechanism inner portion support frame and therefore movable with respect to the mechanism support base;

a first drive assembly connected to the mechanism inner portion; and a second drive assembly connected between the mechanism support base and the mechanism inner portion support frame operating to displace both the mechanism inner portion support frame and the mechanism inner portion with respect to the mechanism support base;

a support plate disposed on each side of the mechanism inner portion, the support plate rigidly fixed to the mechanism inner portion support frame and rotatably coupled to the mechanism support base and the second drive assembly, wherein the support plates and the mechanism inner portion support frame cradle and movably support, on both sides and a bottom, the mechanism inner portion relative to the mechanism support base as part of one rotational unit, wherein the plurality of links are rotatably connected to each of the mechanism support base and the mechanism inner portion support frame in a space laterally between the mechanism support base and the mechanism inner portion support frame, and wherein at least one of the plurality of links extends above the mechanism inner portion support frame; and a frame structure connected to the support base and moved to at least a forward fully raised position by operation of the second drive assembly.

2. The furniture member of claim 1, wherein the mechanism further includes the plurality of links comprising:

at least one guide rotation link extending between and rotatably connected to the support plate and the mechanism support base; and an arc shaped guide link rotatably coupled directly to both the support plate and the second drive assembly wherein operation of the second drive assembly displaces the arc shaped guide link.

3. The furniture member of claim 2, wherein the mechanism further includes:

a connecting shaft extending across and rotatably connected to the mechanism support base and the second drive assembly wherein the connecting shaft has a central axis and operation of the second drive assembly rotates the connecting shaft about the central axis; and a guide connecting link pivotally coupled to the connecting shaft and rotatably connected the arc shaped guide link wherein operation of the second drive assembly rotates the guide connecting link with the connecting shaft to drive the arc shaped guide link and the support plate and moves the mechanism inner portion between a fully raised position and a lowered position.

4. The furniture member of claim 3, wherein the mechanism further includes:

a lift drive plate rotatably connected to and disposed in overlapping relationship with the support plate opposite the mechanism inner portion;

another guide rotation link extending between and rotatably connected to the mechanism support base and the lift drive plate.

5. The furniture member of claim 1, wherein the first drive assembly sequentially operates to extend a leg rest portion from a stowed to a fully extended position followed by rotation of a seat back portion from an upright to a fully reclined position.

6. The furniture member of claim 4, wherein the mechanism further includes:

a guide link displacement member extending between and rotatably connected to the mechanism support base and the lift drive plate that defines a longitudinal slot; and a slide fastener connected to the lift drive plate that is received in the longitudinal slot of the guide link displacement member for limited sliding movement therein.

7. The furniture member of claim 1, wherein the frame structure includes an arm member extending piece transversely connected to each of the first and second arm members, the arm member extending pieces respectively having first and second wing cavities forming slots extending vertically through the arm member extending pieces to individually receive one of a first and a second base sides of a base member when the furniture member is moved to a lowered position.

8. A furniture member providing powered occupant lift, comprising:

a mechanism, including:

a mechanism support base configured to rest on a floor, the mechanism support base having a support base side;

a mechanism inner portion configured for reclination of the furniture member, the mechanism inner portion rotatably connected to the support base side, the mechanism inner portion including:

a seat back portion;

a leg rest portion;

a mechanism inner portion frame interconnecting the seat back portion and the leg rest portion; and a first drive assembly connected to the mechanism inner portion sequentially operating to extend the leg rest portion from a stowed to a fully extended position followed by rotation of the seat back portion from an upright to a fully reclined position;

a second drive assembly connected between the mechanism support base and the mechanism inner portion operating to displace the mechanism inner portion with respect to the mechanism support base;

a support plate disposed on each side of the mechanism inner portion, the support plate non-rotatably fixed to the mechanism inner portion support frame and rotatably coupled to the support base side and the second drive assembly to cradle both the mechanism inner portion support frame and the mechanism inner portion on the mechanism support base as part of one rotational unit;

at least one guide rotation link extending between and rotatably connected to the support plate and the support base side;

a connecting shaft extending across the mechanism support base along a central axis and being rotatably connected to the support base side and the second drive assembly wherein operation of the second drive assembly rotates the connecting shaft about the central axis;

a guide connecting link fixed to the connecting shaft for rotation therewith; and an arc shaped guide link rotatably coupled to both the support plate and the guide connecting link wherein operation of the second drive assembly rotates the connecting shaft and the guide connecting link to rotate the arc shaped guide link and move the support plate and the mechanism inner portion that is carried thereon to the fully raised position;

a lift drive plate rotatably connected to and disposed in overlapping relationship with the support plate opposite the mechanism inner portion;

another guide rotation link extending between and rotatably connected to the support base side and the lift drive plate;

a guide link displacement member extending between and rotatably connected to the support base side and the lift drive plate that defines a longitudinal slot;

a slide fastener connected to the lift drive plate that is received in the longitudinal slot of the guide link displacement member for limited sliding movement therein; and a frame structure connected to the mechanism inner portion and moved to at least a forward fully raised position by operation of the mechanism.

9. The furniture member of claim 8, further including a base member fixedly and non-movably connected to the mechanism support base, the base member including first and second base sides joined by a rear base side connecting piece.

10. The furniture member of claim 8, wherein the frame structure includes an arm member extending piece connected to each of the first and second arm members, each arm member extending piece extending transversely with respect to the first and second arm members and toward the seat back portion and defining one of a first and a second wing cavity in the form of a slot extending vertically through the arm member extending piece to individually receive one of the first and second base sides when the furniture member is moved to a lowered position.

11. The furniture member of claim 8, wherein the mechanism is only operable when the seat back support element is in the upright position and the pantograph linkage set is positioned in the stowed position.

12. The furniture member of claim 8, wherein the seat back portion includes:

first and second inner portion plates; and first and second seat back support elements, each connected to one of the first and second inner portion plates.

13. The furniture member of claim 8, wherein the leg rest portion includes first and second pantograph linkage sets extended and contracted using first and second extension link sets each connected to one of the first and second pantograph linkage sets.

14. The furniture member of claim 8, wherein the support plate defines a slot that receives a rotational fastener rotatably connecting the support plate and the arc shaped guide link wherein the slot of the support plate permits limited sliding movement of the rotational fastener with respect to the support plate.

15. A furniture member providing powered occupant lift, comprising:

a mechanism, including:

a mechanism support base configured to rest on a floor, the mechanism support base having support base first and second sides;

a mechanism inner portion support frame rotatably connected to the first and second sides;

a mechanism inner portion configured for reclination of the furniture member, the mechanism inner portion connected to and supported on the mechanism inner portion support frame by a plurality of links, the mechanism inner portion including:

first and second seat back support elements;

first and second pantograph linkage sets; and a seat back/leg rest drive assembly connected to the mechanism inner portion operating to sequentially extend/retract the first and second pantograph linkage sets and then rotate the first and second seat back support elements;

a lift/drive assembly connected to the mechanism support base including a connecting shaft extending between and rotatably connected to the support base first and second sides and a support plate disposed on each side of the mechanism inner portion, the support plate non-pivotally fixed to the mechanism inner portion support frame and rotatably connected to the connecting shaft, wherein the support plates and the mechanism inner portion support frame cradle and movably support, on both sides and a bottom, the mechanism inner portion relative to the mechanism support base as part of one rotational unit, wherein the plurality of links are rotatably connected to each of the mechanism support base and the mechanism inner portion support frame in a space laterally between the mechanism support base and the mechanism inner portion support frame, wherein at least one of the plurality of links extends above the mechanism inner portion support frame, and wherein the connecting shaft rotates about a central axis to displace the support plate with respect to the mechanism support base;

a base member fixedly and non-movably connected to the mechanism support base; and a frame structure connected to the mechanism inner portion and rotated with respect to the base member by operation of the lift/drive assembly to rotate the mechanism inner portion support frame to at least a fully raised position to assist an occupant supported by the mechanism inner portion to move to a standing position.

16. The furniture member of claim 15, further including a mechanism outer portion first side and a mechanism outer portion second side each connected to one of the support base first or second sides, both movable with respect to the support base.

17. The furniture member of claim 16, wherein the first and second seat back support elements are each rotatably connected to one of the mechanism outer portion first and second sides.

18. The furniture member of claim 15, wherein the first and second pantograph linkage sets are each rotatably connected for both extension and retraction to one of the mechanism outer portion first and second sides.

19. The furniture member of claim 15, wherein the lift/drive assembly further includes:

at least one guide rotation link extending between and rotatably connected to each support plate and the support base first and second sides; and an arc shaped guide link rotatably connecting each support plate to the connecting shaft wherein rotation of the connecting shaft displaces the arc shaped guide link and each support plate.

20. The furniture member of claim 19, wherein the lift/drive assembly further includes:

a lift/drive gear housing;

a gear housing coupling movably disposed on the lift/drive gear housing;

a coupling bracket connected to the gear housing coupling and fixed to the connecting shaft wherein axial movement of the gear housing coupling on the lift/drive gear housing rotates the coupling bracket, the connecting shaft, and the support plate.

21. A furniture member providing powered occupant lift, comprising:

a base member having a front base side connecting piece;

a mechanism having a mechanism support base connected to the base member and configured to rest on a floor, a mechanism inner portion support frame rotatable with respect to the base member by a plurality of links, and a mechanism inner portion configured for reclination of the furniture member, the mechanism inner portion carried on the mechanism inner portion support frame, the mechanism inner portion including a leg rest member;

at least one drive assembly connected to the mechanism operating to rotate the mechanism inner portion support frame with respect to the base member, the at least one drive assembly including a support plate disposed on each side of the mechanism inner portion, the support plate fixed to the mechanism inner portion support frame such that the mechanism inner support frame cannot move relative to the support plate, the support plate being is rotatably coupled to the mechanism support base, wherein the support plates and the mechanism inner portion support frame cradle and movably support, on both sides and a bottom, the mechanism inner portion relative to the mechanism support base as part of one rotational unit, wherein the plurality of links are rotatably connected to each of the mechanism support base and the mechanism inner portion support frame in a space laterally between the mechanism support base and the mechanism inner portion support frame, and wherein at least one of the plurality of links extends above the mechanism inner portion support frame; and a frame structure connected to the mechanism inner portion and rotated to at least a forward fully raised position by operation of the at least one drive assembly, the leg rest member at the forward fully raised position oriented at an angle with respect to the front base side connecting piece, and the frame structure having a front lower corner displaced forward of the front base side connecting piece at the forward fully raised position thereby creating a cavity between the front lower corner, the front base side connecting piece and a planar surface supporting the base member.

22. The furniture member of claim 21, wherein the at least one drive assembly includes:

a first drive assembly connected to a mechanism inner portion, the first drive assembly operated to displace the leg rest member; and a second drive assembly connected between the mechanism support base and the mechanism inner portion support frame operated to displace the mechanism inner portion support frame with respect to the mechanism support base.

23. The furniture member of claim 22, wherein the mechanism inner portion includes first and second seat back support elements rotated by operation of the first drive assembly.

24. The furniture member of claim 21, wherein the at least one drive assembly further includes:

at least one guide rotation link extending between and rotatably connected to the support plate and the mechanism support base; and an arc shaped guide link rotatably connected to the support plate wherein operation of the at least one drive assembly displaces the arc shaped guide link and the support plate.

25. The furniture member of claim 24, wherein the at least one drive assembly further includes:

a connecting shaft extending across and rotatably connected to the mechanism support base for rotation about a central axis that is co-axial with the connecting shaft; and a guide connecting link fixed to the connecting shaft and rotatably connected to the arc shaped guide link wherein rotation of the connecting shaft about the central axis rotates the guide connecting link and drives the arc shaped guide link and the support plate to move the mechanism inner portion between a fully raised position and a lowered position.

26. A furniture member providing powered occupant lift, comprising:

a base member having first and second base sides;

a mechanism having a mechanism support base fixedly connected to the first and second base sides and configured to rest on a floor, a mechanism inner portion support frame rotatable with respect to the base member by a plurality of links, and a mechanism inner portion configured for reclination of the furniture member, the mechanism inner portion carried on the mechanism inner portion support frame, the mechanism inner portion including a leg rest member extensible from the mechanism inner portion by first and second pantograph linkage sets;

a first drive assembly connected to the mechanism inner portion operating in a first mode to extend the first and second pantograph linkage sets and thereby extend the leg rest member to a fully extended position;

a second drive assembly connected between the mechanism support base and the mechanism inner portion support frame operated to displace the mechanism inner portion support frame with respect to the mechanism support base, the second drive assembly including a support plate disposed on each side of the mechanism inner portion, the support plate fixed to the mechanism inner portion support frame and rotatably coupled to the mechanism support base, wherein the support plates and the mechanism inner portion support frame cradle and movably support, on both sides and a bottom, the mechanism inner portion relative to the mechanism support base as part of one rotational unit, wherein the plurality of links are rotatably connected to each of the mechanism support base and the mechanism inner portion support frame in a space laterally between the mechanism support base and the mechanism inner portion support frame, and wherein at least one of the plurality of links extends above the mechanism inner portion support frame; and a frame structure connected to the mechanism inner portion and rotated to each of a rearward zero gravity position or a forward fully raised position by operation of the second drive assembly, the leg rest member when positioned at the fully extended position and elevated above the support plate defining the rearward zero gravity position.

27. The furniture member of claim 26, wherein the base member includes a front base side connecting piece connected to and oriented perpendicular to the first and second base sides.

28. The furniture member of claim 27, wherein the leg rest member at the frame structure forward fully raised position is located in a stowed position abutting the frame structure and is oriented at an angle with respect to the front base side connecting piece.

29. The furniture member of claim 26, wherein the second drive assembly further includes:

at least one guide rotation link extending between and rotatably connected to the support plate and the mechanism support base; and an arc shaped guide link rotatably connected to the support plate wherein operation of the at least one drive assembly displaces the arc shaped guide link and the support plate.

30. The furniture member of claim 29, wherein second drive assembly further includes:

a connecting shaft extending across and rotatably connected to the mechanism support base for rotation about a central axis that is co-axial with the connecting shaft; and a guide connecting link fixed to the connecting shaft and rotatably connected to the arc shaped guide link wherein rotation of the connecting shaft about the central axis rotates the guide connecting link and drives the arc shaped guide link and the support plate to move the mechanism inner portion between a fully raised position and a lowered position.

31. The furniture member of claim 26, wherein the mechanism inner portion includes first and second seat back support elements rotated by operation of the first drive assembly in a sequential operation following extension of the leg rest member to the fully extended position.

32. The furniture member of claim 31, further including a seat back member connected to the first and second seat back support elements, the seat back member rotatable from a fully upright to a fully reclined position, the seat back member when rotated to the fully reclined position by sequential operation of the first drive assembly after the leg rest member is positioned in the fully extended position defining a second rearward zero gravity position.

33. A furniture member providing powered occupant lift, comprising:

a mechanism, including:

a mechanism support base configured to rest on a floor;

a mechanism inner portion support frame movably connected to the mechanism support base;

a mechanism inner portion configured for reclination of the furniture member, the mechanism inner portion carried on the mechanism inner portion support frame and therefore movable with respect to the mechanism support base;

a frame structure connected to the support base and moved to at least a forward fully raised position by rotation of the mechanism;

a base member having the mechanism support base fixed to the base member; and a side-to-side stabilizing system connected to the mechanism inner portion and to the base member minimizing side-to-side movement of the mechanism with respect to the base member, the side-to-side stabilizing system including:

a slotted link rotatably connected to an arc shaped guide link of the mechanism having an elongated slot; and a fixed link fixed to the base member and having a slide pin connected to the fixed link and extending through the elongated slot, the slide pin limiting a displacement of the slotted link during rotation of the mechanism.

34. The furniture member of claim 33, wherein the fixed link includes:

a planar portion supporting the slide pin; and opposed first and second flange ends positioned outward of the planar portion, the first and second flange ends fixedly connected to the base member.

35. The furniture member of claim 33, further including a first drive assembly connected to the mechanism inner portion.

36. The furniture member of claim 35, further including a second drive assembly connected between the mechanism support base and the mechanism inner portion support frame operating to displace both the mechanism inner portion support frame and the mechanism inner portion with respect to the mechanism support base.

37. The furniture member of claim 33, wherein the side-to-side stabilizing system includes a polymeric material guide plate positioned between a mechanism support plate, an inner portion plate of the mechanism, and an inner portion of the arc shaped guide link.

38. The furniture member of claim 33, wherein the side-to-side stabilizing system further includes:

a polymeric glide connected to and extending outwardly from the slotted link, the glide slidably contacting the base member during rotation of the mechanism.

* * * * *